US009843127B2

(12) United States Patent
Liu et al.

(10) Patent No.: US 9,843,127 B2
(45) **Date of Patent: *Dec. 12, 2017**

(54) CONNECTOR ASSEMBLY

(71) Applicant: Otter Products, LLC, Fort Collins, CO (US)

(72) Inventors: Feng Song Liu, San Diego, CA (US); Brian C. Bone, San Diego, CA (US); Feng Feng, Sugar Land, TX (US); Nicholas J. Murrells, San Diego, CA (US)

(73) Assignee: Otter Products, LLC, Fort Collins, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/183,903

(22) Filed: Jun. 16, 2016

(65) Prior Publication Data

US 2016/0294106 A1 Oct. 6, 2016

Related U.S. Application Data

(63) Continuation of application No. 14/582,041, filed on Dec. 23, 2014, now Pat. No. 9,398,365, which is a (Continued)

(51) Int. Cl.
*H04R 1/10* (2006.01)
*H04R 1/28* (2006.01)
(Continued)

(52) U.S. Cl.
CPC ..... *H01R 13/5202* (2013.01); *H01R 13/5219* (2013.01); *H01R 13/622* (2013.01); (Continued)

(58) Field of Classification Search
CPC ..... H01R 9/0524; H01R 13/6275; H01R 13/625; H01R 13/627; H01R 13/6273; H01R 13/6276; H01R 13/6277
See application file for complete search history.

(56) References Cited

U.S. PATENT DOCUMENTS 3,143,384 A 8/1964 Senior
4,440,464 A 4/1984 Spinner
(Continued)

*Primary Examiner* — Fan Tsang
*Assistant Examiner* — Angelica M McKinney

(57) ABSTRACT

This disclosure presents a connector assembly for providing a waterproof connection to a case for an electronic device. The connector assembly includes a connector body, an electrical cable, and an electrical conductor. The electrical conductor is electrically connected to the electrical cable and electrically engages the installed electronic device to convey at least one of data and power between the installed electronic device and the electrical cable. The connector assembly also includes an outer sleeve configured to freely rotate around the connector body and further configured to removably connect the connector assembly to the case. The outer sleeve includes a securing region to removably secure the connector assembly to the case, an inner gasket to seal an inner sealing interface of the outer sleeve with the connector body, and an outer gasket positioned to seal an outer sealing interface of the outer sleeve with the case.

19 Claims, 33 Drawing Sheets

Related U.S. Application Data continuation-in-part of application No. 14/222,536, filed on Mar. 21, 2014, now Pat. No. 9,161,114.

(60) Provisional application No. 61/920,395, filed on Dec. 23, 2013, provisional application No. 61/804,605, filed on Mar. 22, 2013.

(51) Int. Cl.

| | |
|---|---|
| ***H01R 13/52*** | (2006.01) |
| ***H04R 1/44*** | (2006.01) |
| ***H01R 13/622*** | (2006.01) |
| ***H01R 24/58*** | (2011.01) |

(52) U.S. Cl.

CPC ..... *H01R 24/58* (2013.01); *H04R 1/1016* (2013.01); *H04R 1/1033* (2013.01); *H04R 1/1041* (2013.01); *H04R 1/1066* (2013.01); *H04R 1/44* (2013.01); *H04R 1/1075* (2013.01); *H04R 1/2815* (2013.01); *H04R 2460/17* (2013.01)

(56) References Cited

U.S. PATENT DOCUMENTS

| | | | | |
|---|---|---|---|---|
| 4,683,587 | A | 7/1987 | Silverman | |
| 5,092,458 | A | 3/1992 | Yokoyama | |
| 5,167,522 | A | 12/1992 | Behning | |
| 5,423,692 | A | 6/1995 | Francis | |
| 6,396,769 | B1 | 5/2002 | Polany | |
| 6,614,722 | B2 | 9/2003 | Polany et al. | |
| 6,685,493 | B2 | 2/2004 | Birkenmaier et al. | |
| 7,263,032 | B2 | 8/2007 | Polany et al. | |
| 7,726,999 | B2 | 6/2010 | Vanzo | |
| 7,740,499 | B1 | 6/2010 | Willey et al. | |
| 7,789,696 | B2 | 9/2010 | Umei et al. | |
| 8,210,859 | B2 | 7/2012 | Tiberghien et al. | |
| 8,611,969 | B2 | 12/2013 | Smith et al. | |
| 8,920,192 | B2 * | 12/2014 | Montena | H01R 9/05 439/320 |
| 8,932,084 | B2 * | 1/2015 | Thackston | H01R 13/5227 439/676 |
| 9,124,048 | B2 * | 9/2015 | Golko | H01R 13/052 |
| 9,142,925 | B2 * | 9/2015 | Golko | H01R 13/642 |
| 9,398,365 | B2 * | 7/2016 | Liu | H04R 1/1016 |
| 2002/0009195 | A1 | 1/2002 | Schon | |
| 2002/0064981 | A1 | 5/2002 | Yu et al. | |
| 2008/0171456 | A1 | 7/2008 | Vanzo | |
| 2009/0041284 | A1 | 2/2009 | Tanaka et al. | |
| 2009/0180243 | A1 * | 7/2009 | Lynch | H01R 13/6271 361/679.01 |
| 2011/0017620 | A1 | 1/2011 | Latchford et al. | |
| 2011/0300730 | A1 * | 12/2011 | Someya | H01R 13/6273 439/271 |
| 2012/0039500 | A1 | 2/2012 | Silvestri et al. | |
| 2012/0196464 | A1 | 8/2012 | Lu | |
| 2013/0095699 | A1 * | 4/2013 | Brun | H01R 13/04 439/638 |
| 2013/0182881 | A1 | 7/2013 | Horino et al. | |
| 2013/0224993 | A1 | 8/2013 | Purdy | |
| 2014/0146979 | A1 * | 5/2014 | Puskarich | H04R 5/033 381/74 |

* cited by examiner

CONNECTOR ASSEMBLY

CROSS-REFERENCE TO RELATED APPLICATIONS

This application is a continuation of U.S. Ser. No. 14/582,041, filed Dec. 23, 2014, which is a continuation-in-part of U.S. Ser. No. 14/222,536, filed Mar. 21, 2014, now U.S. Pat. No. 9,161,114, which claims priority to U.S. Provisional Patent Application Ser. No. 61/804,605, filed Mar. 22, 2013, and U.S. Provisional Patent Application Ser. No. 61/920,395 filed Dec. 23, 2013. The disclosures of each of the patent applications cited in this paragraph are hereby incorporated by reference in their entireties.

FIELD

This disclosure relates generally to waterproof electronic assemblies, such as earphones, earphone electronic controls, as well as waterproof connectors.

BACKGROUND

Portable headphone speakers for listening to sound, whether used alone, in combination with a microphone for use with a mobile communication device, e.g., a cell phone, or to amplify external sounds, as with a hearing aid, can have a variety of configurations. Small headphones that fit in the concha bowl of the ear and direct sound into the ear canal, such as earbuds and earmolds, are preferred by some users due to their smaller size and weight relative to larger headphones that fit over the concha and/or pinna of the ear. This "in ear" style of headphone is often desirable during exercise, such as running or biking, or other physical activity that may include sudden or forceful movements of the head. It is desirable to have an earpiece or earmold associated with the headphone that retains the headphone in the ear while moving, and is still comfortable to wear.

Furthermore, it is desirable to have earphones that are waterproof when using a mobile communication device during exercise. Athletes and others who train or exercise may expose the headphones to their own sweat, as well as outdoor elements such as rain and snow. Entry of liquids into non-waterproof earphones can partially or completely inhibit their operation. Earphones that can be utilized and controlled when connected to a mobile communication device, e.g., a phone or tablet, despite exposure to or submersion in water, are highly desirable.

Moreover, it is also desirable to have a waterproof connector that can be connected to an encasement or another connector by rotating only a portion of the connector to achieve a watertight connection. By rotating only a portion of the connector, a user does not need to rotate the entire connector and cable in order to create a waterproof seal, allowing one-handed attachment, as well as minimizing the possibility of creating loops and tangles in the cable itself.

SUMMARY

This disclosure describes a connector assembly for providing a waterproof connection to a case for an electronic device at an aperture of the case and for providing an electrical connection to an electrical interface of the electronic device when the electronic device is installed in the case. The connector assembly includes a connector body, an electrical cable attached to the connector body, and an electrical conductor at least partially contained in the connector body. The electrical conductor is electrically connected to the electrical cable and electrically engages the electrical interface of the installed electronic device through the aperture of the case to convey at least one of data and power between the installed electronic device and the electrical cable when the connector assembly is removably connected to the case. The connector assembly also includes an outer sleeve surrounding at least a portion of the connector body where the outer sleeve is configured to freely rotate around the connector body when the connector assembly is being connected to the case and is further configured to removably connect the connector assembly to the case at the aperture. The outer sleeve includes a securing region on a first end of the outer sleeve to removably secure the connector assembly to the case when the outer sleeve is rotated around the connector body. The outer sleeve further includes an inner gasket positioned to seal an inner sealing interface of the outer sleeve with the connector body when the connector assembly is connected to the case. Finally, the outer sleeve also includes an outer gasket positioned to seal an outer sealing interface of the outer sleeve with the case when the connector assembly is connected to the case.

The instant disclosure also provides apparatuses for transmitting sound from a headset to an ear of a wearer, as well as apparatuses for sealing a cable entrance to a housing against water and particles, such as for an earphone or a multi-function input for an earphone assembly.

The instant disclosure provides an earpiece for transmitting sound from a headphone to an ear of a wearer. The earpiece includes an earmold for fitting within a concha cavum (concha bowl) of the typical wearer's ear. The earmold includes a main body having a shape substantially corresponding with the concha cavum and having a hollow sound channel therein. The hollow sound channel extends from an inlet provided proximate the headphone to a sound channel output port positioned proximate an inferior region of the concha cavum. The earmold further has a posterior arch extending out from a side of the earmold opposite the sound channel output port, the posterior arch to compress against an antihelix region of the concha cavum to maintain the earmold within the concha cavum of the ear of the wearer.

In some embodiments, the earpiece further includes a thinned region in a mid-region of the main body. The thinned region allows the main body of the earpiece to deform against curvatures of the concha cavum to conform to the ear of the wearer. The earpiece may further include at least one hole proximate the posterior arch, allowing deformity of the posterior arch against compression by the antihelix region of the concha cavum. In some embodiments, the earpiece further includes at least two holes being separated by at least one rib connected between the posterior arch and the main body of the earmold. In some embodiments, the earpiece further includes a fin extending from the posterior arch of the earmold and adapted to reach at least partially into a concha cymba region of the ear of the wearer. In some embodiments, the fin is offset toward an exterior side of the earmold at the posterior arch.

The instant technology also provides electronic component assemblies, such as for earphones, multifunction inputs, and displays having an electrical or optical cable connecting with the electronic components. The electronic component assemblies are configured to prevent entry of water and small particles into the component assembly where the cable enters the assembly housing. Such an electronic component assembly includes: one or more electronic components; a cable having electrical or optical connectivity to the one or more electronic components; and a housing configured to house the one or more electronic components. The housing has an interior surface and an exterior surface, and may include two or members that come together to form a housing. The housing members may be adhered with a waterproof or water resistant adhesive, or be welded together. In some embodiments, one housing member may include a channel and a housing seal or gasket positioned within the channel, and the other housing member may have one or more elements that at least partially compress the housing gasket in the channel to form a waterproof or water resistant seal. The housing also includes a cable aperture through which the cable extends, and a compression backstop extending into the interior of the housing.

The electronic component assembly also includes a gasket holder or sealing interface element having a compression face and a gasket seat face, the gasket holder surrounding the cable. The electronic component assembly also includes a gasket surrounding the cable and positioned at the gasket seat, as well as a compression wedge and a crimp bead securely surrounding the circumference of the cable. The gasket is at least partially compressed between the gasket seat and the interior surface of the housing proximate the cable aperture. The compression wedge at least partially surrounding the circumference of the cable, and is positioned between the compression backstop and the compression face of the gasket holder. The crimp bead securely surrounds the circumference of the cable, and is positioned proximate the compression backstop.

In some embodiments of the electronic component assembly, the housing is waterproof and the gasket seals the cable aperture from entry by water.

In some embodiments, the compression wedge has a gap on one side. In some embodiments, the compression wedge completely surrounds the circumference of the cable.

In certain embodiments of the electronic component assembly, the compression backstop further includes two compression arms extending from the interior surface of the housing, the compression arms partially surrounding the circumference of the cable. In some embodiments, the compression backstop comprises a wall, the wall having an aperture through which the cable extends.

The instant disclosure also provides an electronic component assembly that includes one or more electronic components housed in an internal housing. The internal housing has at least one internal cable aperture and at least one gasket seat on an outside surface of the internal housing and positioned proximate the cable aperture. The internal housing may include two or members that come together to form the internal housing. The internal housing members may be adhered with a waterproof or water resistant adhesive, or be welded together. In some embodiments, one internal housing member may include a channel and a housing seal or gasket positioned within the channel, and the other internal housing member may have one or more elements that at least partially compress the housing gasket in the channel to form a waterproof or water resistant seal. The electronic component assembly also includes a cable having electrical or optical connectivity to the one or more electronic components. The cable is positioned through the internal cable aperture. The assembly further includes an external housing configured to house the internal housing. The external housing has an interior surface and an exterior surface, an external cable aperture through which the cable extends, and at least two anchor protrusions that extend into the interior of the housing.

The electronic component assembly also includes an anchor element surrounding the circumference of the cable, and has a proximal end portion, a distal end portion, and at least three side portions. The anchor element further includes at least one slot in each of at least two side portions, configured to interact with the at least two anchor protrusions and preventing the anchor element from sliding within the housing.

The electronic component assembly also includes a gasket surrounding the cable. The gasket is at least partially compressed between the interior surface of the internal housing proximate the internal cable aperture and the proximal end portion of the anchor element. The electronic component assembly also includes a crimp bead securely surrounding the circumference of the cable, and is positioned proximate the interior surface of the internal housing.

In some embodiments of an electronic component assembly having an internal housing, the internal housing is waterproof and the gasket prevents entry of water through the at least one internal cable aperture.

The instant disclosure also provides an electronic component assembly that includes one or more electronic components housed in an internal housing. The internal housing has at least one internal cable aperture, an internal surface, and an external surface. The electronic component assembly further includes a cable having electrical or optical connectivity to the one or more electronic components and is inserted through the internal cable aperture.

In addition, the electronic component assembly includes an external housing configured to house the internal housing. The external housing has an interior surface and an exterior surface, an external cable aperture through which the cable extends, and a compression backstop extending into the interior of the housing.

The electronic component assembly also includes: a compression wedge that at least partially surrounds the circumference of the cable; a gasket surrounding the cable; and a crimp bead securely surrounding the circumference of the cable proximate the interior surface of the internal housing. The gasket is at least partially compressed between the exterior surface of the internal housing proximate the internal cable aperture and the compression wedge.

In some embodiments of the electronic component assembly having an internal housing, the internal housing is waterproof and the gasket seals the internal cable aperture from entry by water.

In some embodiments, the compression wedge has a gap on one side. In some embodiments, the compression wedge completely surrounds the circumference of the cable.

In certain embodiments of the electronic component assembly, the compression backstop further includes two compression arms extending from the interior surface of the housing, the compression arms partially surrounding the circumference of the cable. In some embodiments, the compression backstop comprises a wall, the wall having an aperture through which the cable extends.

In some embodiments of the electronic component assemblies described above, the one or more electronic components comprise an earphone assembly for producing sound. In some embodiments, the one or more electronic components include a microphone assembly for detecting sound. In certain embodiments, the one or more electronic components include at least one button to control an electronic device, at least one display for displaying information from an electronic device, or both.

The disclosure also provides a connector assembly for providing a waterproof connection to a threaded aperture in an encasement. The threaded aperture provides access to a female socket or a male connector of an electronic device that is at least partially encased by the encasement. The connector assembly includes a connector body coupled with an electrical cable, the electrical cable for conveying electrical signals from the electrical connection of the electronic device. The connector body has a cylindrical portion that includes at least one ridge protruding from an external surface of the cylindrical portion. The connector assembly also includes an elongated male connector or female connector extending from the cylindrical portion of the connector body. The elongated male connector or female connector is sized and adapted for insertion into and engagement within the female socket or male socket, respectively. Also included in the connector assembly is an inner gasket around the elongated male member and abutting the cylindrical portion of the connector body. For a female connector, the inner gasket may be positioned surrounding a perimeter of an aperture of the female connector. The connector assembly also includes a sleeve bearing having a cylindrical inner surface rotatably interfaced with the external surface of the cylindrical portion of the connector body opposite the elongated male connector from the inner gasket. The cylindrical inner surface has at least one groove formed therein, each of the at least one groove receives one of the at least one ridge protruding from the external surface of the cylindrical portion to allow rotation of the sleeve bearing relative to the connector body in a substantially fixed longitudinal position on the cylindrical portion of the connector body. The connector assembly also includes a rotating outer sleeve or bushing having a gripping region connected with and at least partially covering the sleeve bearing. The bushing further has a threaded region with an inner surface rotatably interfaced around a portion of the elongated male or female connector opposite the sleeve bearing from the inner gasket to allow the elongated male or female connector to extend from the threaded region. The threaded region has external threads sized and adapted for threading with the threaded aperture of the encasement when the gripping region is rotated. In addition, the bushing further has an inner sealing interface coupled with the inner gasket to seal the elongated male member with the cylindrical portion of the connector body. The connector assembly also includes an outer gasket coupled around the bushing between the gripping region and the threaded region of the bushing, the outer gasket to seal the threaded region with the threaded aperture of the encasement when the threaded region is threaded with the threaded aperture of the encasement.

In some embodiments, the connector assembly further includes one or more ridges on an exterior surface of the gripping region of the outer sleeve or bushing. The sleeve bearing may include a first semi-cylindrical part coupled with a second semi-cylindrical part. In certain embodiments, the connector assembly further includes a strain relief cover that contains at least a portion of the electrical cable. The strain relief cover of the connector assembly may be coupled with and extend from the connector body. In certain embodiments, the connector body is offset from an axis defined by the strain relief cover and electrical cable, where the strain relief cover extends from the connector body. The bushing may be press-fit onto the sleeve bearing, or the bushing may be adhered to the sleeve bearing. In certain embodiments, when the external threads of the threaded region are fully threaded with the threaded aperture of the encasement, the elongated male connector engages within the female socket. If the connector assembly includes a female connector, when the external threads of the threaded region are fully threaded with the threaded aperture of the encasement, the elongated female connector engages within the male connector. In certain embodiments, the outer gasket is unitary with the threaded region of the bushing.

The summary of the technology described above is non-limiting and other features and advantages of the invention will be apparent from the following detailed description of the invention, and from the claims.

DETAILED DESCRIPTION OF THE DISCLOSURE

The present disclosure is directed to an apparatus for comfortably securing an earpiece in the concha of a user's ear, such that the earpiece is not easily shifted in position during use, especially during vigorous physical activity such as jogging or biking, in which the ear may be subjected to movement that may otherwise jostle the earpiece from the ear. It is desirable to have an earpiece or earmold associated with the headphone that is comfortable to wear, and can be used by users in a variety of differently shaped ears while remaining securely retained in the ear even when the ear experiences forceful movement.

The present disclosure is also directed to earphones that are waterproof and dustproof, or resistant to intrusion of liquids such as water and sweat. The earphones may be connected via a cable to a waterproof, dustproof multi-function input (MFI) that may include a microphone and buttons. The earphones may be connected to via a cable to a waterproof, dustproof audio connector that can form a waterproof seal when connected to a case that houses an electronic device or to an adapter that connects to such a case.

As used herein, the term "exterior side" refers to a portion of the earmold that faces outward, away from the ear, when mated with an earpiece and inserted into the concha bowl of a user's ear. Conversely, the term "interior side" refers to the portion of the earmold that faces inward, towards the ear, when mated with an earpiece and inserted into the concha bowl of the ear.

The term "about" as used herein in reference to quantitative measurements, refers to the indicated value plus or minus 10%.

Earmolds

The present disclosure is directed to an apparatus for more comfortably securing an earpiece in the concha of an ear, such that the earpiece is not easily shifted in position during use, especially during vigorous physical activity, such as jogging or biking, in which the ear may be subjected to movement that may otherwise jostle the earpiece from the ear. It is desirable to have an earpiece or earmold, associated with the headphone, that can be comfortably worn by users having a variety of outer ear shapes while remaining securely retained in the ear even when the ear experiences forceful movement.

Figure 1:
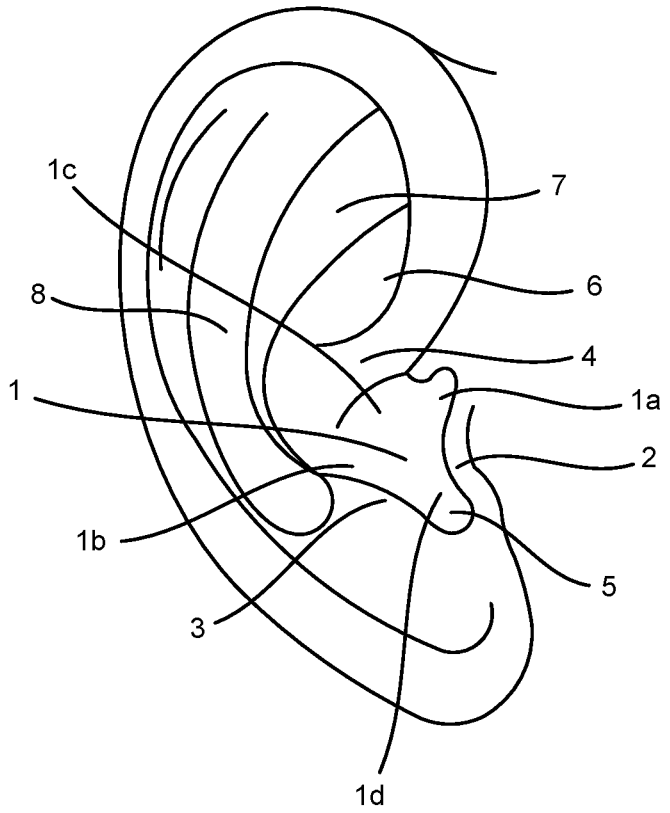
FIG. 1 shows certain external anatomical features of the human ear.

FIG. 1 depicts the external human ear and some of its anatomic features. The concha cavum 1 (or concha bowl) is framed by the tragus 2, antitragus 3, and crus of helix 4. In the context of this application, the concha bowl has four subregions, the anterior concha cavum 1*a*, the posterior concha cavum 1*b*, the superior concha cavum 1*c*, and the inferior concha cavum 1*d*. The intertragic notch 5 is a gap that lies between the tragus and antitragus. The concha cavum lies directly next to the ear canal (not shown). The concha cymba 6 lies above the crus of helix 4 and below the anterior crus 7 of the antihelix 8. While most ears have these features, their exact dimensions and orientation vary significantly from person to person. Thus, making one or two sizes of earmolds configured to fit in the concha cavum while being comfortable and secure fitting for many different people is difficult to achieve. While some earphones are designed to use hooks that reach around the outside of the ear, into structures of the ear such as the antihelix and helix, or be inserted directly into the ear canal, such configurations can be uncomfortable for the user and may lack the ability to be maintained in the ear effectively during strenuous exercise. For earbuds designed to rest within the concha cavum, differing shapes of concha cavae among users may result in a loose fit, allowing the earbud to move within the concha cavum and affect the sound quality delivered to the user. Moreover, the lack of proper fit within the concha cavum can result in a user feeling as if the earbud will fall out of the ear, even if the earphone is secured in the ear. The earmolds described herein allows for fitting inside many different shapes of concha cavae, while providing enough pressure both at the anterior concha cavum and the posterior concha cavum to maintain the earmold inside the concha cavum during forceful and/or repetitive head movements and to provide the user with a feeling of fullness in the concha cavum and minimizing discomfort.

Figure 2A:
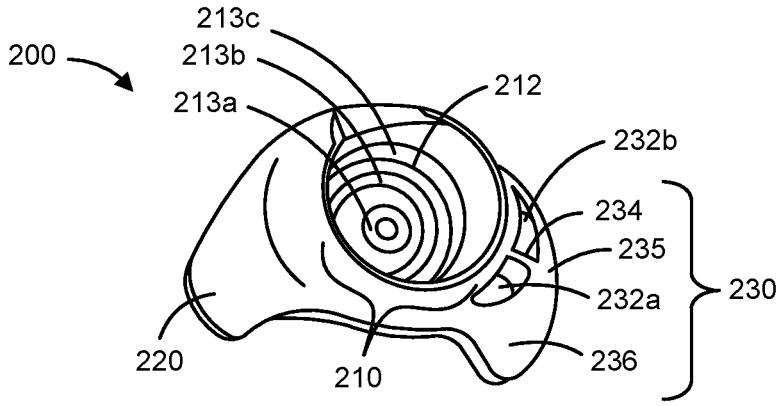
FIGS. 2A-D show perspective and side views of an earmold.

FIG. 2A shows a perspective view of a right-ear earmold 200 from the exterior side, in an inverted orientation (i.e. upside down with respect to an upright person's ear). An earmold cavity 210 is configured to hold an earpiece that transmits sound. The earmold is made of a firm but flexible elastomeric material, such as silicone or rubber that allows for the earmold to be mated with an earpiece inside the cavity, as well as to allow some compliance in different regions of the earmold. In certain embodiments, an elastomeric material may have a hardness of between about 25 and about 30 Shore A. In some embodiments, the earmold may include an indentation or hole (e.g., shown as 422 in FIG. 4) that is contiguous with the cavity of the earmold, and is configured to mate with a tab on the earpiece. The tab-hole mating aids in preventing the earmold from rotating around the earpiece and/or separating from the earpiece.

At the bottom of the cavity 210 is a thinned region 212. The thinned region depicted in FIG. 2A is circular in shape, although in some embodiments it may have other shapes, such as ovoid or polygonal (e.g., triangular, rectangular, pentagonal, hexagonal, etc.). The thickness of the thinned region 212 is sufficiently small to allow the earmold to be deformed slightly in one or more directions when inserted into a concha cavum. For example, the earmold may be deformed by force exerted by one or more of the ear structures surrounding the anterior concha cavum, posterior concha cavum, superior concha cavum, and the inferior concha cavum. In some embodiments, the thinned region may not be uniformly thin, but may be interspersed by regions that are not thinned. The circular ripples 213*a-c* seen on the thinned region are ornamental; the thinned region may be smooth in appearance in some embodiments, or may have other designs molded in. The thinned region may be about 0.1 mm to about 1 mm in thickness, whereas the remainder of the earmold may have a thickness of about 2 mm to about 4 mm in thickness.

The earmold also includes a sound channel output port 220 that is hollow and allows sound from the earpiece to be directed into the ear canal. When the earmold is inserted into the concha cavum, the sound channel at the anterior portion of the earmold points towards and is proximate the entrance of the ear canal, but does not enter the ear canal itself. In some embodiments, the sound channel may enter a portion of the ear canal. In some embodiments, the anerior portion of the earmold will press against the anterior concha cavum, the posterior portion of the earmold will press against the posterior concha cavum, and the inferior portion of the earmold will press against the inferior concha cavum of a user's ear to secure the earmold and provide a feeling of fullness within the concha cavum. In some embodiments, more force is exerted between the anterior concha cavum and the posterior concha cavum than is exerted downward against the inferior concha cavum.

The earmold of FIG. 2A also includes a posterior region 230 that may include holes 232*a* and 232*b* and a rib or strut 234 that lies underneath a posterior arch or exterior ridge 235. In some embodiments, the earmold includes two or more holes and one or more struts. The number and orientation of the struts between the holes may be modified to adjust the stiffness and compliance of the posterior arch 235, and thus the amount of force needed for the posterior concha cavum to deform the earmold. In the embodiment illustrated in FIG. 2A, strut 234 is short in length and has a straight axis from posterior arch 235 towards earmold cavity 210. In some embodiments, the strut may be curved and longer in length, affecting the compliance of the posterior region (see e.g., FIG. 6H). In some embodiments, the earmold has one, two, three, four, or five struts. In addition, the length of the struts can be varied to adjust the amount of force needed for the posterior concha cavum to deform the earmold. When the earmold is inserted into the ear, force from the posterior concha cavum presses against the posterior arch of the earmold and deforms the ribs that lie underneath the arch. In other embodiments, the earmold may include no holes or struts in the posterior region 230, and the thickness of the posterior arch 235 or the whole posterior region 230 may permit or inhibit deformation of the earmold for a given amount of force. If sufficient force is exerted on the earmold by the posterior concha cavum, the earmold may deform near the thinned region 210 as well. The earmold also includes a fin or flange 236 emerging from (with respect to ear position) just above the posterior region 230. The fin or flange 236 may facilitate securing the earmold in the concha cavum. When the earmold is inserted in the concha cavum, the fin or flange 236 reaches partially into the concha cymba and may press against the crus of helix, depending on a particular user's ear anatomy (see FIG. 1 for ear anatomy).

Figure 2B:
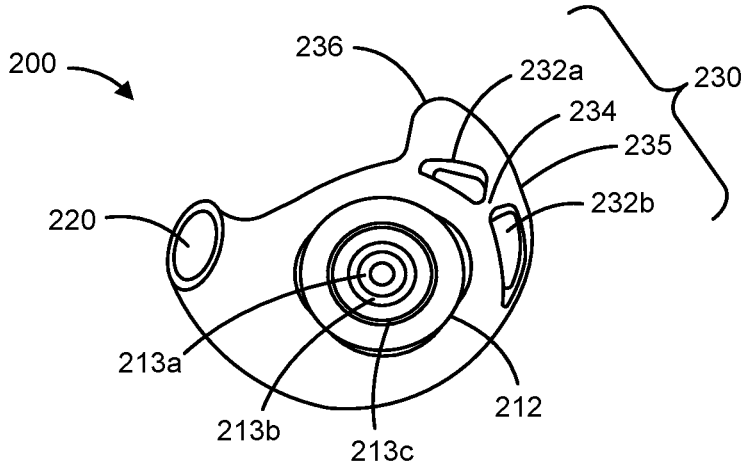

FIG. 2B shows a side view of the interior side of the earmold 200, with the thinned region 212, circular ripples 213*a-c*, sound channel 220, holes 232*a-b*, rib 234, posterior arch 230 and fin 236.

Figure 2C:
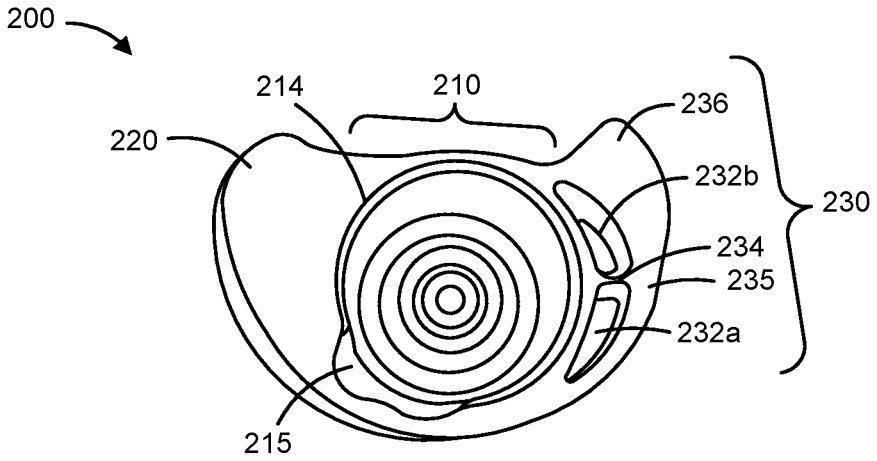
Figure 2D:
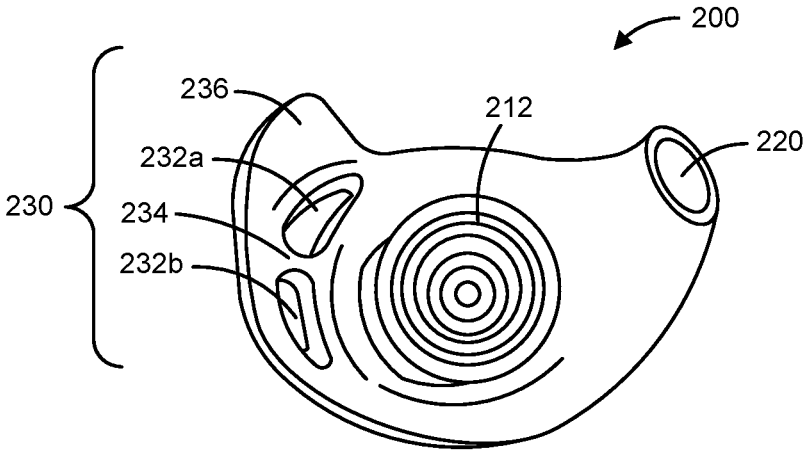

FIG. 2C depicts a side view of the exterior side of a left-ear earmold, rotated 180 degrees compared to FIG. 2A. Numbering is the same as for FIGS. 2A and 2B in referring to like members. The earmold cavity 210 has an exterior ridge 214, and in some embodiments may have a gap 215 or cutout that is configured to allow wires and/or part of the body of an earpiece to lie proximate the earmold. FIG. 2D is a side view of the interior side of the left-ear earmold 200.

Figure 3:
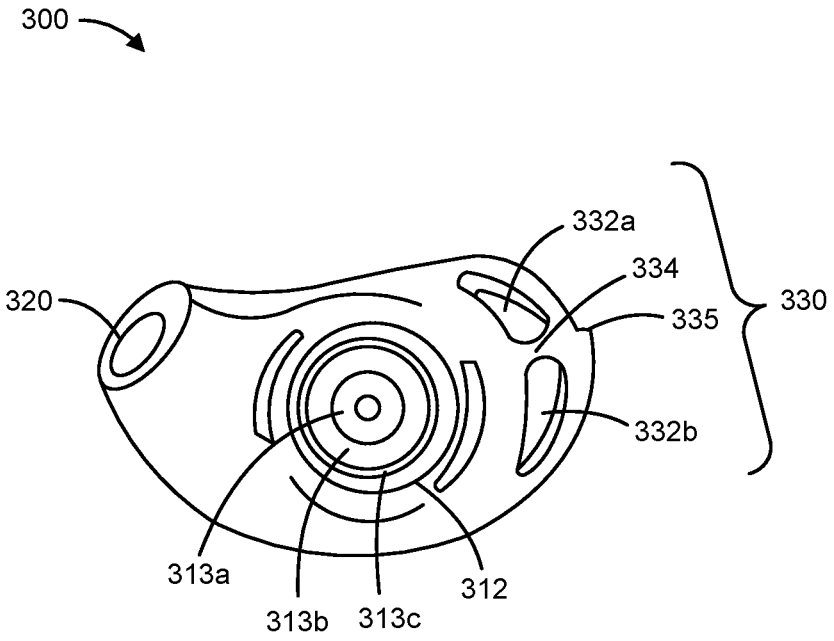
FIG. 3 shows a side view of an earmold lacking a flange.

In some embodiments of the present technology, the earmold does not have a fin or flange 236. FIG. 3 shows a side view of an interior side of a right-ear earmold 300, and that lacks a fin emerging from the posterior arch 335 as shown. Similar to FIGS. 2A-2D, the embodiment depicted in FIG. 3 also includes a thinned region 312, circular ripples 313*a-c*, a sound channel output port 320, and posterior region 330. The posterior region 330 includes holes 332*a-b* separated by a rib 334 and having a posterior arch that frames the holes 332*a-b* and rib 334.

Figure 4:
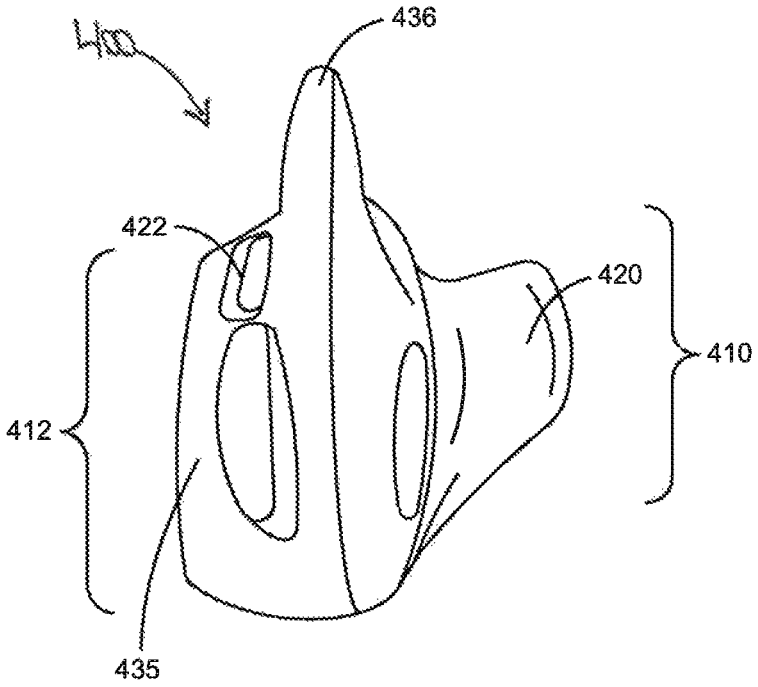
FIG. 4 shows a posterior side view of an earmold having a flange and securing aperture.

FIG. 4 depicts an embodiment of an earmold 400 that includes a flange 436 (similar to that of FIG. 2). FIG. 4 shows a rear view of the earmold facing the posterior arch 435, and shows the flange 436 and sound channel 420 relative to the interior side 410 (the side inserted into the concha cavum of the ear) and exterior side 412 of the earmold 400. In some embodiments of the earmold, the fin or flange 436 may be offset (not shown), lying closer to the exterior side of the earmold 400 to accommodate a portion of the crus of helix when the earmold is inserted into the concha cavum. This relieves pressure on the crus of helix from the flange 436, while still allowing the flange itself to rest inside the concha cymba. In some embodiments, the fin may be curved (convex) outward to reduce pressure on the crus of helix. FIG. 4 also shows a securing aperture 422 that may receive and mate with a tab on an earpiece inserted into the earmold to, for example, prevent unwanted movement of the earmold with respect to the earpiece. In some embodiments, the earmold may have a securing indentation, instead of a securing hole, that is contiguous with the cavity of the earmold, and aids in preventing the earmold from rotating around the earpiece and/or separating from the earpiece (see, e.g., FIGS. 6H and 6I discussed below).

The earmold described above may be a molded cover made of an elastomeric material, or it may be overmolded directly on or to the surface of an earpiece.

Waterproof Earphone

Earphones that fit inside the concha cavum of an ear may include waterproof earphones that rest inside the concha cavum without additional support (e.g., earbuds), or may be attached to an additional support mechanism that aids in preventing slippage or movement of the earbuds within the concha cavum. Exemplary support mechanisms may include a headband that partially encircles the top, front, or rear of the head, or structures for individually securing each earphone to its respective ear, e.g. ear clips or in-ear tension/friction support mechanisms such as described above. Additional support mechanisms like these may be made of firm plastic or other polymer that flexes, and may incorporate cloth and elastic components. The support mechanisms may also include electronic components such as a multifunction input (described below), a microphone, and/or a BLUETOOTH transceiver.

Figure 5A:
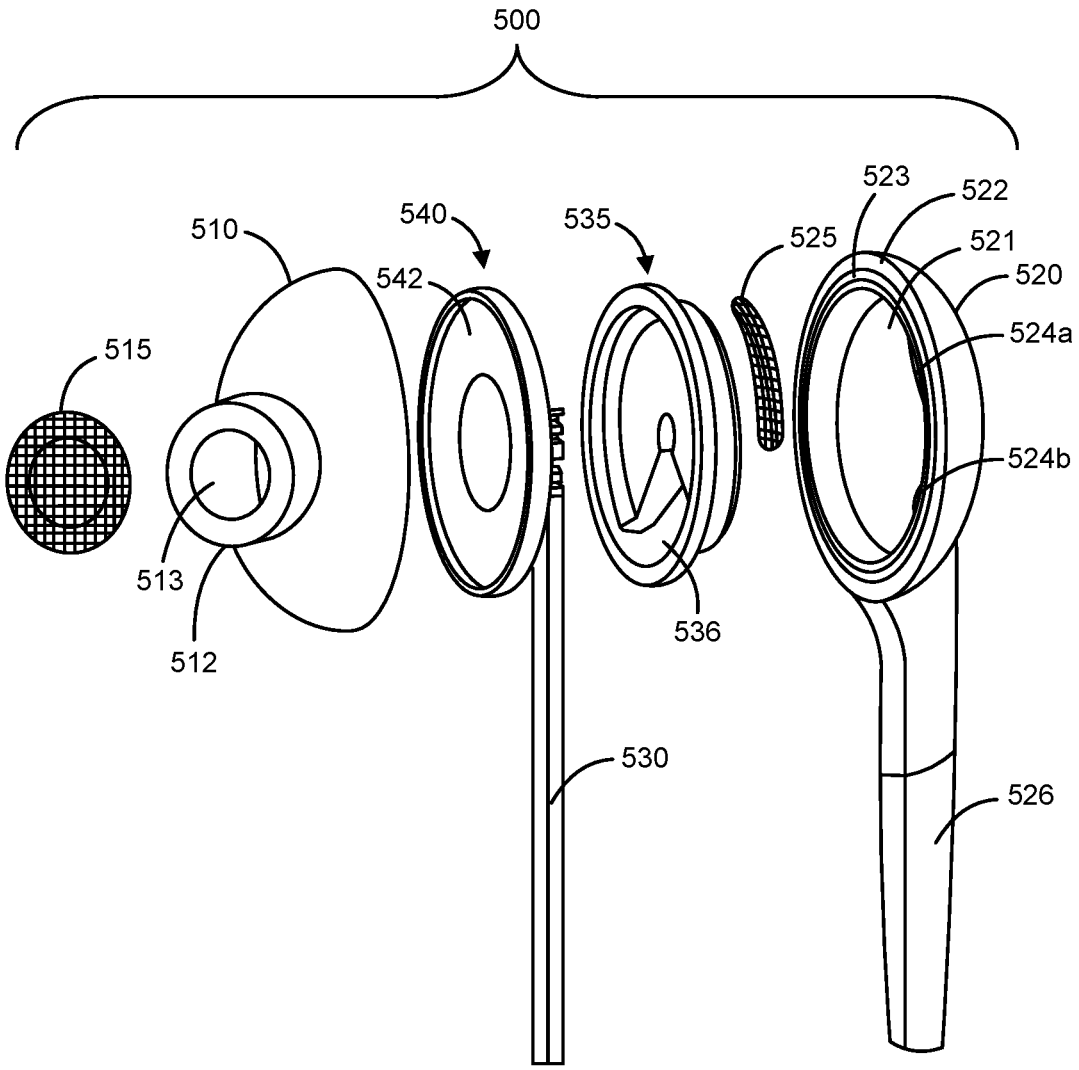
FIG. 5A shows an exploded perspective view of a waterproof earphone assembly.

An exemplary waterproof earphone 500 of the instant technology is depicted in the exploded perspective view of FIG. 5A. Rear member 520 and front member 510 enclose the entire earphone 500, and are adhered to each other with a waterproof adhesive and/or welded (e.g., ultrasonically welded) together to prevent ingress of water or solid particles. The rear member 520 includes a rear member cavity 521 that is surround by a perimeter ridge 522. The cavity 521 is configured to at least partially surround the inner components of the earphone. The perimeter ridge 522 of the rear member 520 further includes a seal 523. The seal may be an O-ring or gasket positioned around the perimeter ridge. The rear member also includes rear member vents 524*a* and 524*b* covered by a rear vent membrane 525 that is adhered to the rear member 520. The rear vent membrane 525 is waterproof but preferably allows gases such as air to move in and out of the earphone assembly. A strain relief cover 526 extends from the bottom of the rear member 520 and encloses cable 530 when the earphone 500 is assembled. The strain relief cover 526 is made of a waterproof material such as plastic or other polymer and is flexible, but stiffer than the rest of cable to prevent the cable from losing electrical contact due to continuous use and wear (e.g., frequent bending of the cable 530 at the earphone). A tuning backing 535 is positioned proximate the rear member 520 and includes a cable aperture 536 that allows the cable extending from the diaphragm assembly 540 to pass through the tuning backing 535 and exit the earphone assembly 500. The tuning backing 535 also includes a plurality of apertures (not shown) that may be modified in number and/or size in order to tune the earphone to produce the overall frequency response desired. The diaphragm assembly 540 includes a diaphragm 542 and is connected to the cable 530. A front member 510 is positioned proximate the diaphragm assembly 540 and includes an sound funnel 512 having a sound channel 513 that directs sound into a user's ear canal. A waterproof sound channel membrane 515 is adhered to the opening of the sound funnel 512. Like the rear vent membrane, the sound channel membrane 515 is gas permeable.

Figure 5B:
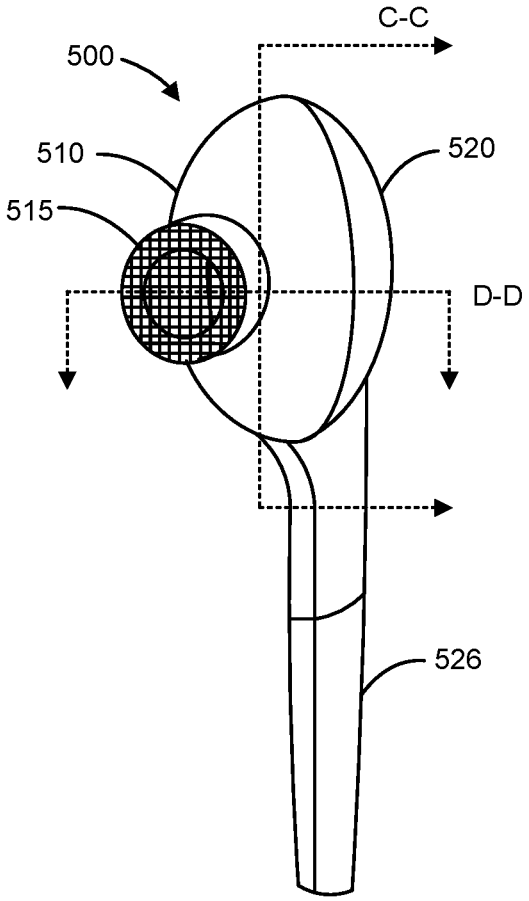
FIG. 5B is a perspective view of the assembled waterproof earphone of FIG. 5A.
Figure 5C:
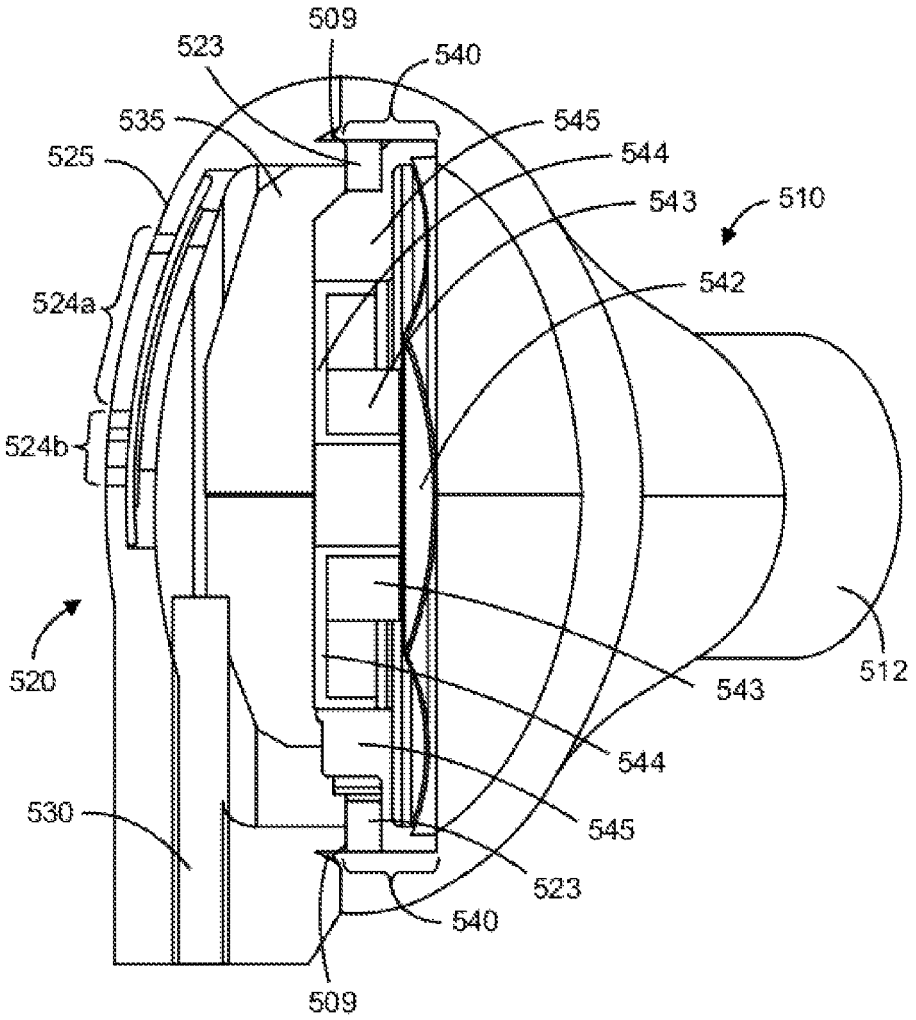
FIG. 5C is a sectional view of the waterproof earphone assembly, through a side of a diaphragm.

FIG. 5B shows assembled waterproof earphone 500 and indicates sections C-C (FIG. 5C) and D-D (FIG. 5D) with dotted lines. FIG. 5C shows a rear-side sectional view of the waterproof earphone 500 shown in FIG. 5B (section C-C, through the front member 510 and rear member 520 facing towards the sound funnel 512). The rear member 520 and front member 510 enclose the earphone 500 at a joint 509 that may be ultrasonically welded, adhered with a waterproof adhesive, such as epoxy or urethane adhesives, or both. The seal 523 may be positioned proximate the joint 509 and is partially compressed between the front and rear members to provide additional sealing against liquid entry. The seal 523 may be a separate gasket, and in some embodiments may be adhered to either the front or rear member. In some embodiments, two seal rings attached respectively to each of the front and the rear members and are partially compressed to form a waterproof seal. In certain embodiments, the seal 523 may be overmolded to a perimeter portion of the front member, the rear member, or both the front and rear members. The tuning backing 535 may be positioned proximate the rear portion of the diaphragm assembly 540.

Cable 530 extends through an aperture in strain relief cover 526 (not visible) and into rear member 520, extends through the tuning backing 535, and is electrically connected to the diaphragm assembly (for clarity, FIG. 5C does not show the connection). Rear member vents 524*a* and 524*b* are covered by a single rear vent membrane 525 adhered to the interior surface of the rear member 520. One having ordinary skill in the art would recognize that only a single vent or a plurality vents may be used in the rear member, and that the vents can vary in size (as shown in FIG. 5C) as well as shape. The rear member vents may be covered by a single rear vent membrane or by multiple rear vent membranes. Diaphragm assembly 540 includes the diaphragm 542 associated with a magnet 543. A housing for the diaphragm assembly includes an inner diaphragm housing 544 and outer diaphragm housing 545 that are adhered, bonded, or welded together. In some embodiments, a single diaphragm housing can be used in place of the inner and outer diaphragm combination.

Figure 5D:
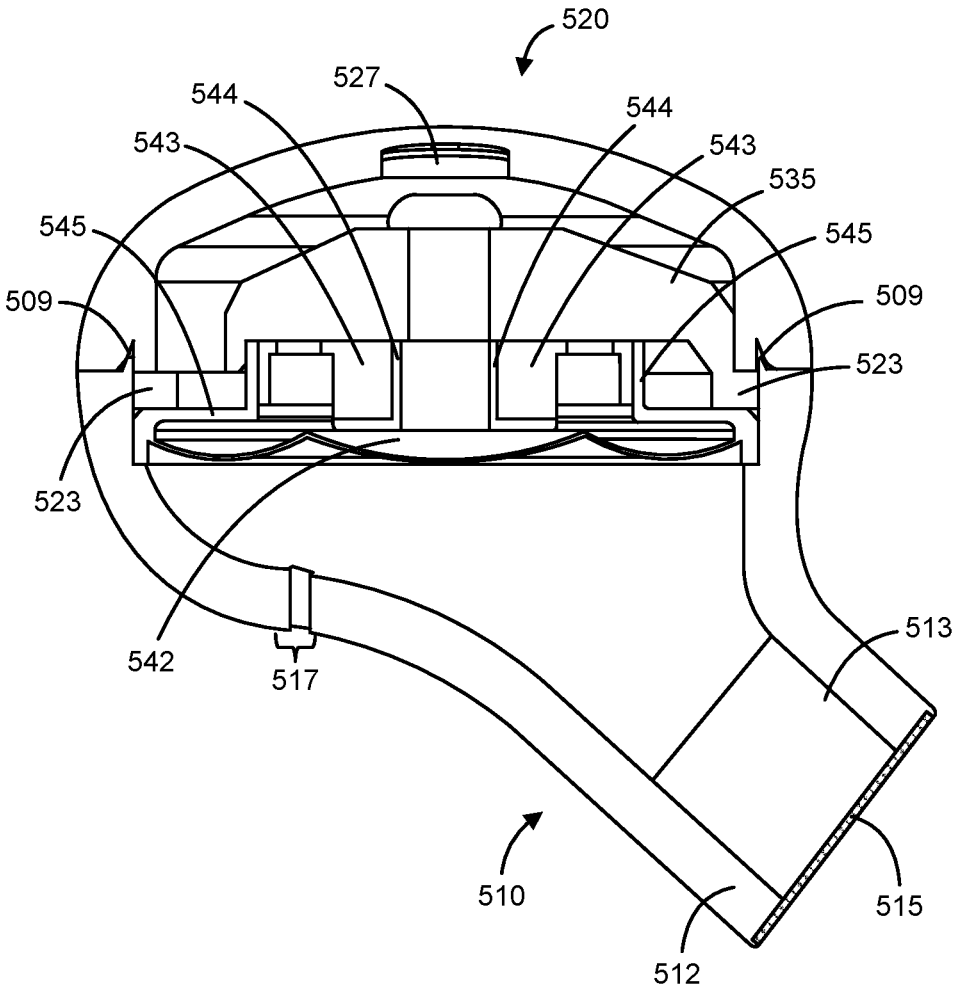
FIG. 5D is a side sectional view of the waterproof earphone assembly through both the diaphragm and a sound funnel.
Figure 5E:
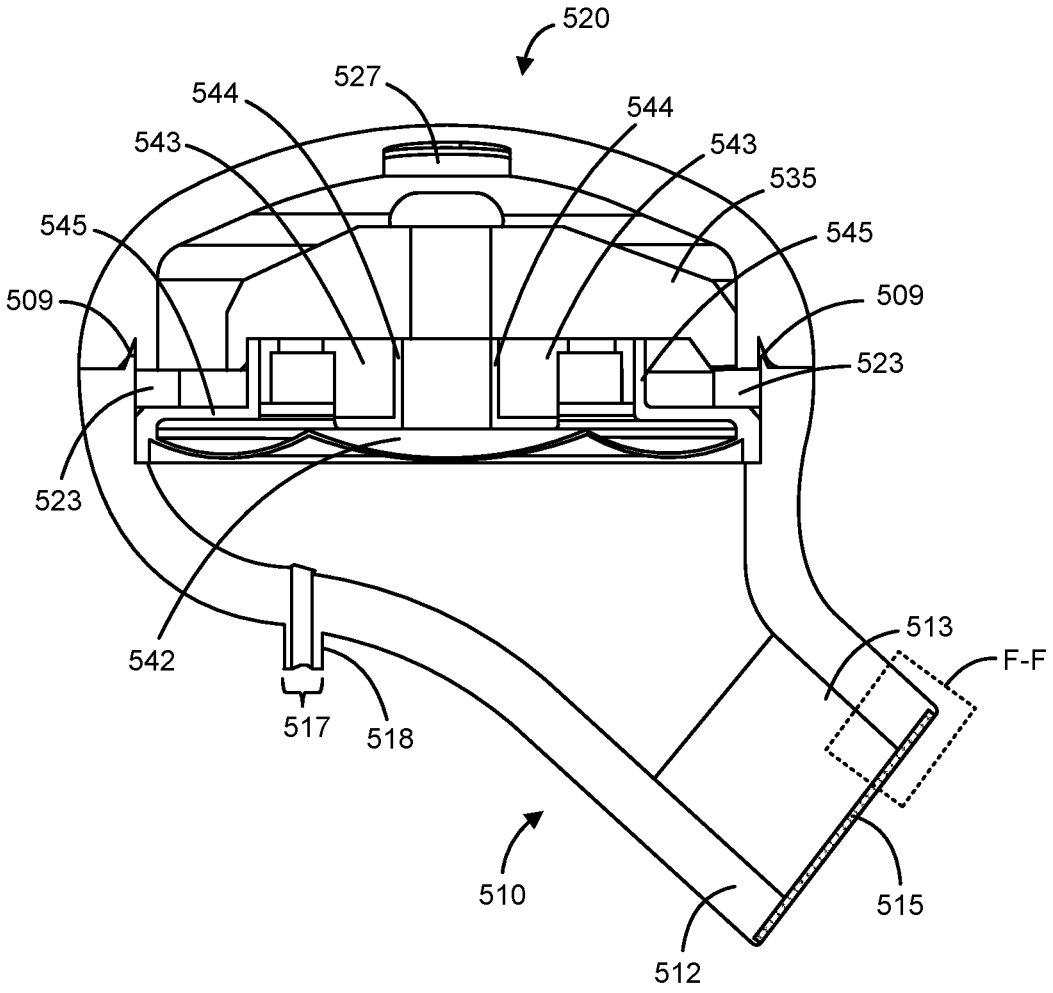
FIG. 5E is a sectional view of an alternative embodiment of the earphone assembly of FIG. 5D that includes an exterior sound pipe.

FIG. 5D shows a sectional top view of the waterproof earphone of FIGS. 5A and 5C, in a different orientation and plane from the cross section depicted in FIG. 5C. The front member 510 of the earphone assembly may include a tuning aperture 517 that is covered by a tuning aperture membrane (not shown) that is gas permeable. FIG. 5C also shows a cable slot 527 that allows the cable to reach the attachment point (not shown; see FIG. 5D) for the diaphragm assembly. In certain embodiments, the tuning aperture 517 may be used to further tune the frequency response of the earphone assembly. For example, the length of the tuning aperture 517 may be extended with the addition of an exterior sound pipe 518 molded, adhered, or welded to the front member, and that extends beyond the exterior of the front member 510 (see, e.g., FIG. 5E). In some embodiments, the sound pipe may extend into the interior of front member 510, depending on the tuning properties desired.

Figure 5F:
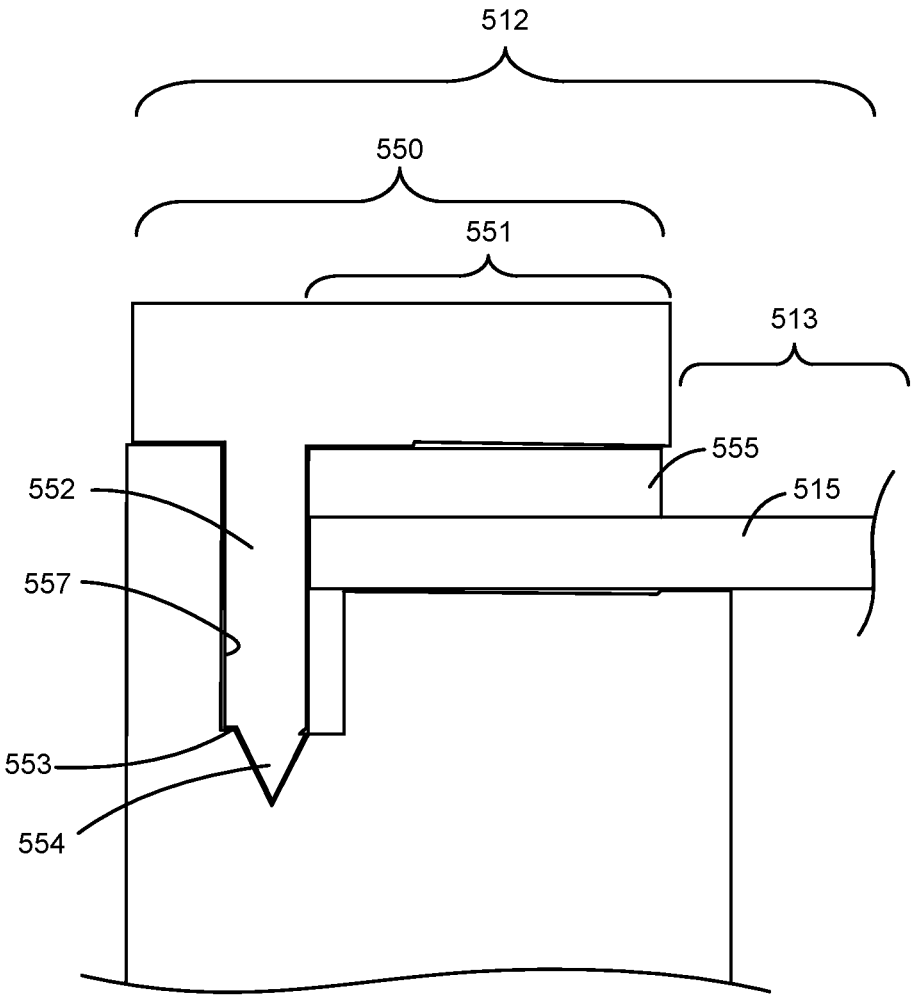
FIG. 5F shows a sectional view of a portion of a sound funnel, with a waterproof sound channel membrane and cap.

In certain embodiments, the waterproof sound channel membrane 515 may be affixed to the sound funnel 512 with a cap. FIG. 5F depicts close-up view of the sound funnel 512, with an additional cap (see area labeled F-F in FIG. 5E). Sound funnel 512 includes a waterproof sound channel membrane 515 that extends across the sound channel 513. A cap or cover 550 is positioned over the circumference of the sound funnel 512 and holds the sound channel membrane 515 in place with an adhesive layer 555. The cap 550 includes a securing portion 551 that is positioned over a portion of the circumference of the sound funnel 512 and facilitates compressing the adhesive layer 555 and waterproof membrane 515 to the circumference of the sound funnel 512. The cap 550 also includes an alignment wall 552 that extends from the cap 550 to a bottom ridge 553. A portion of the alignment wall 552 is positioned in a channel or trough 557 at the circumference of the sound funnel 512, and facilitates alignment of the cap 550 onto the sound funnel 512. The bottom ridge 553 of the alignment wall 552 may be ultrasonically welded at joint 554 where the bottom ridge 553 and the bottom of channel 557 converge. Exemplary waterproof textiles and meshes that may be utilized as waterproof sound channel membranes include hydrophobic material such as polytetrafluoroethylene (ePTFE), as well as woven and non-woven textiles coated with hydrophobic material, such as expanded GORE-TEX, ULTREX, and some SEFAR acoustic HF materials, such as 75-19BHY or Acoustic IP 34-33 (Sefar Inc., Buffalo, N.Y., USA). In some embodiments, the weld may be formed at any region of the channel 557 where the alignment wall is in contact with or in close proximity to the channel. In some embodiments, the alignment wall 552 is adhered to the channel 557 with a waterproof adhesive. In certain embodiments, adhesive layers may be positioned on either side (top and/or bottom) of the sound channel membrane 515 to facilitate adherence of the securing portion 551 of the cap 550, the membrane 515, and the circumference of the funnel 512.

Figure 5G:
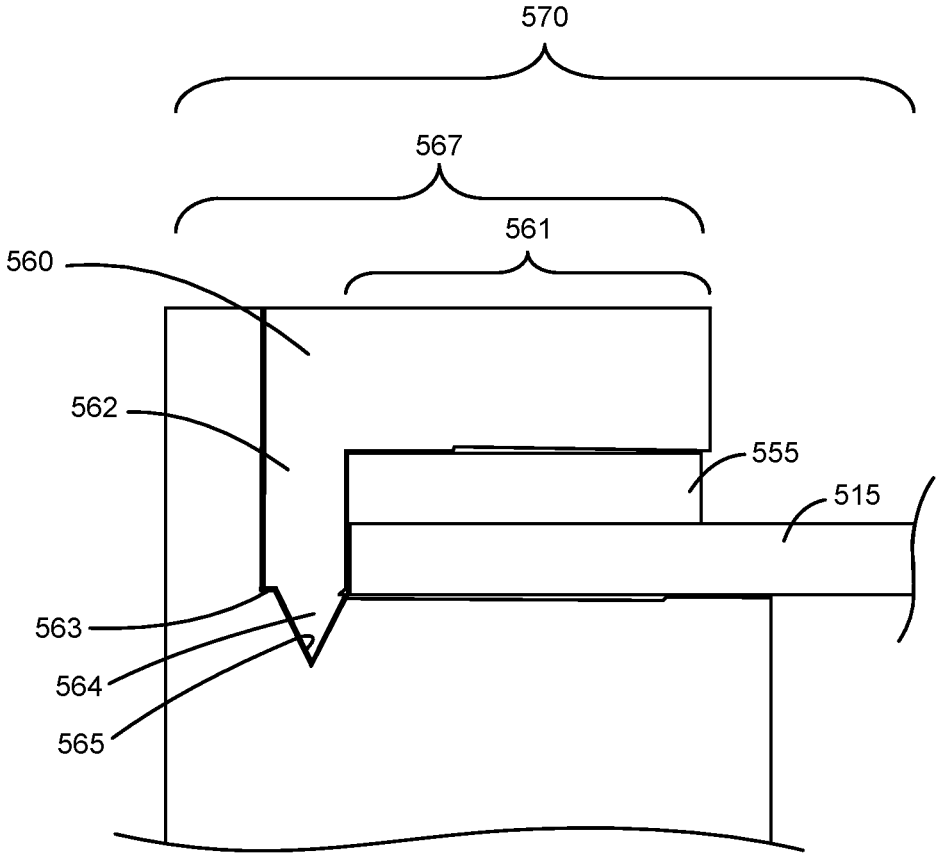
FIG. 5G depicts an alternative embodiment of a sound funnel covered by a waterproof membrane and cap.

FIG. 5G depicts an alternative embodiment of a cap 560 configured to interact with an alternative embodiment of a sound funnel or duct 570 (alternative to sound funnel 512 of previous Figures), wherein a securing portion 561 is positioned at the top of the alignment wall 562, and the bottom ridge 563 is positioned at or near the bottom of a counterbore 567 (instead of a channel as shown in FIG. 5F) on the sound funnel or duct 570. The bottom ridge 563 of the alignment wall 562 may be ultrasonically welded at joint 564 to a notch 565 at the bottom of the counterbore 567. It will be appreciated by those of ordinary skill in the art that the notch and ridge may alternatively be excluded, such that the alignment wall 562 is affixed to corresponding areas of the counterbore 567.

Figure 6A:
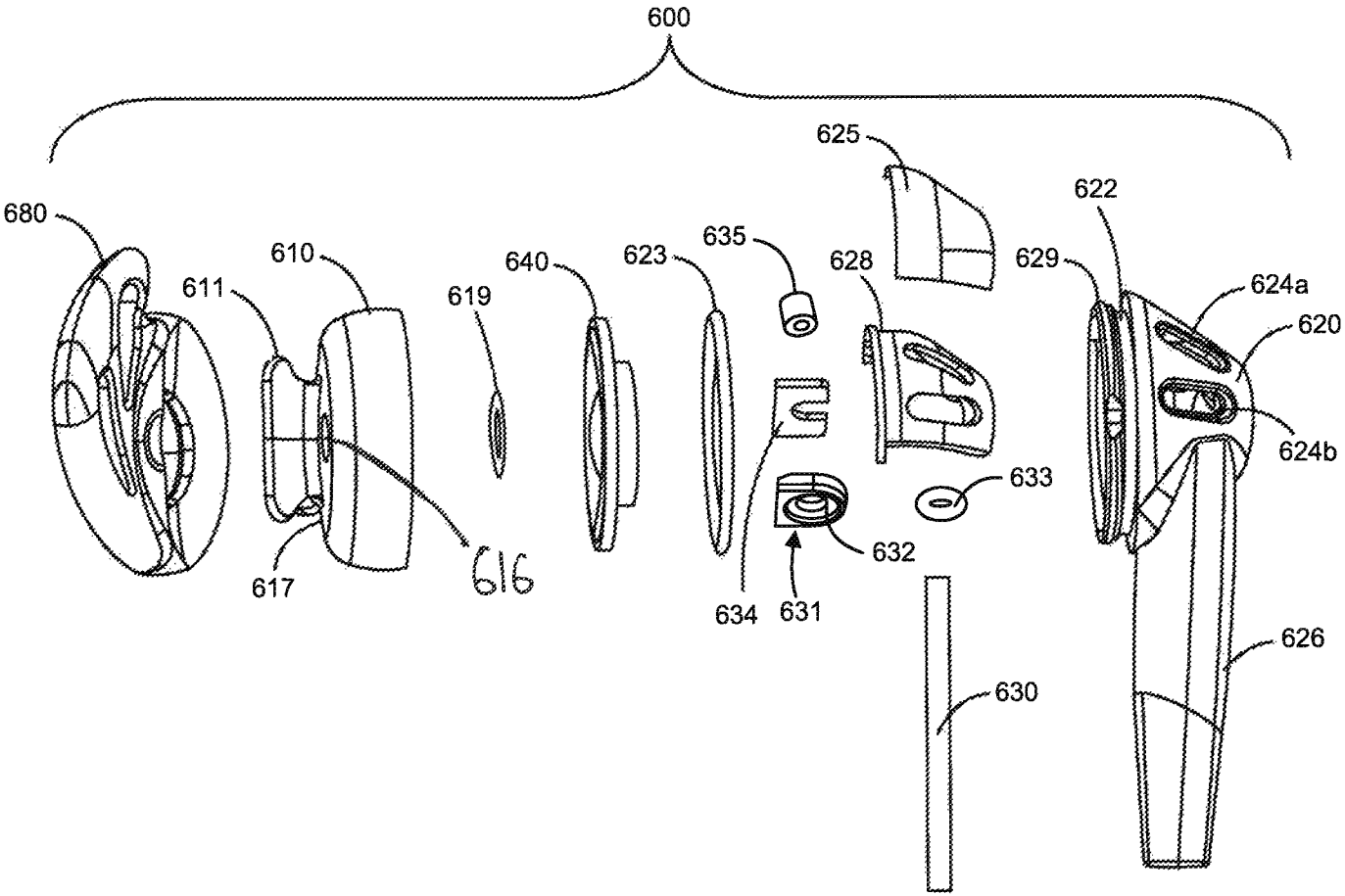
FIG. 6A shows an exploded perspective view of a waterproof earphone assembly.

In alternative embodiments of waterproof earphones, the earphone may include additional components such as compression arms, a compression wedge, and a crimp bead that aid in maintaining a waterproof seal where the cable enters the earphone housing. FIG. 6A shows an exploded perspective view of another embodiment of an earbud 600, including a front member 610 and a rear member 620, that together enclose and seal internal components of the earbud, including the driver or diaphragm assembly 640. The front member 610 includes an anchor protrusion 611 and a sound funnel (not shown). The anchor protrusion 611 is configured to fit into a securing aperture (not shown) in an earmold 680. The earmold or eartip 680 is made from one or more elastomeric materials (e.g., silicone rubber, ethylene propylene rubber, and the like), such that the earmold can be stretched over the sound funnel (not shown) and anchor protrusion 611. As described above, the earmold may be configured to rest comfortably in the concha cavum of an ear. Front member 610 also includes a tuning aperture 617 that can be manufactured at a variety of diameters and/or lengths (using a sound pipe as described above) in order to emphasize or de-emphasize certain frequencies produced by the earphone. For example, a tuning aperture may positioned proximate the center of driver 640, near where sound channel 613 emerges from the earphone 600, or farther from the center of driver 640. A tuning aperture membrane 619 is also shown, and is positioned over the tuning aperture 617 to prevent entry of liquid and/or particles. Diaphragm assembly 640 is attached to cable 630 and rests between the front member 610 and rear member 620.

Rear member 620 includes a strain relief cover 626 that houses cable 630, and includes one or more rear member vents 524*a* and 524*b*. The rear member vents 624*a-b* (624*c* not visible) are covered by a rear vent membrane 625 and membrane plate 628. Membrane plate 628 is configured to secure vent membrane 625 to the interior surface of the rear member 620 and seal it against intrusion by liquids and/or particles. Membrane plate may be secured using a waterproof adhesive and/or ultrasonic welding. In some embodiments, the membrane 625 and membrane plate 628 may be secured to the exterior of the rear member. Rear member 620 also includes protrusion 629 configured to interact with a notch and protrusion (not shown) on the perimeter edge of front member 610 and aid in preventing accidental separation of the front and rear members. It is appreciated by those of ordinary skill in the art that the secure vent membrane 625 may include a single piece to cover all of the rear member vents, or may include two or pieces each corresponding to one or more of the rear member vents. In some embodiments, an adhesive may be added to secure the front and rear members. In certain embodiments, the front and rear members may be configured to be press-fit together, with or without adhesive to aid in preventing the separation of the two members. Rear member 620 also includes a channel 622 where the seal 623 is positioned. In certain embodiments, the earbud 600 may also include a tuning backing (not shown), as described above. FIG. 6A also shows a gasket holder or sealing interface 631 (including a gasket seat 632), a seal or gasket 633, a sealing wedge 634, and crimp bead 635 that are used to seal the cable and aid in holding it in place as described in detail below.

The sound output characteristics of the earphone described herein are affected by several factors, including the surface area of the driver, the geometry of the driver within the earphone housing, the surface area of the front member vents (e.g. sound vent 616) and rear member vents (e.g. 624*a-c*), the acoustic and mechanical characteristics of the waterproof mesh covering the vents, the volume of the stem portion of the earphone (e.g. strain relief cover 626), and the geometry of the front member opening (e.g. sound funnel 612).

In some embodiments, the driver may be about 14.2 mm in diameter in order to produce a desired level of bass frequencies, while still maintaining an overall earphone size that is retained safely and comfortably in the ear. The driver in earphone 600 may also placed much closer to the front member 610 of the earphone housing, reducing the volume of air in front of the increasing the air volume of the earphone at the rear of the driver. In some embodiments, the volume of the cavity in front of driver 640 may be about 0.4 $cm^3$, including the volume of the sound channel. In some embodiments, nozzle or sound channel 613 may have a truncated cone or funnel shape to aid in sound wave propagation out of the earbud and into a user's ear. In some embodiments of the sound channel, the opening of the sound channel is may be slanted to enlarge the surface area of the opening. In some embodiments, the surface area of the sound channel opening may be about 13 $mm^2$ and the length of the sound channel may be about 6.6 mm.

Front member vent 616 may be used to attenuate decibel levels of a specific frequency range. For example, the front member vent may have a surface area of about 3.8 $mm^2$ to attenuate mid-high frequencies, for example between about 2500 kHz and about 3500 kHz.

In some embodiments, the volume of the cavity behind driver 640 may be about 1 $cm^3$, and may be shaped with a truncated cone or funnel-like shape to maximize back pressure amplification, with a widest point near the driver and narrowing some distance from the rear of the driver. In some embodiments, rear vents 624*a-c* may be sized differently to accentuate and attenuate different frequencies. For example, rear vent 624*c* may have a surface area of about 5 $mm^2$, rear vent 624*a* may have a surface area of about 6 $mm^2$, and rear vent 624*b* may have a surface area of about 6.5 $mm^2$. The surface areas of vents 624*a-c* may be adjusted and varied, and more or fewer vents may be used in the earphones to achieve desired acoustic characteristics.

Additional volume may be added in the stem region of the earphones where the cable exits the earphone housing.

In some embodiments of earphones, a minimum response loss within about 35 dB (90-55) deviation across a frequency range of about 50 Hz to about 20 kHz can be achieved, as well as enhancement of frequencies between about 4 kHz to about 8 kHz, and a suppression of frequencies between about 2500 kHz to about 3500 kHz. For example, an earphone with such response loss parameters may be achieved using: a driver of about 14.2 $mm^2$ diameter; a front member volume of about 0.4 $cm^3$; a sound channel with a slanted opening with a surface area of about 13 $mm^2$ and a length of about 6.6 mm; a front member vent with a surface area of about 3.8 $mm^2$; a rear member with a funnel-like shape and a volume of about 1 $cm^3$; three rear member vents with surface areas of about 5 $mm^2$, about 6 $mm^2$, and about 6.5 $mm^2$; and no volume in the stem portion.

Figure 6B:
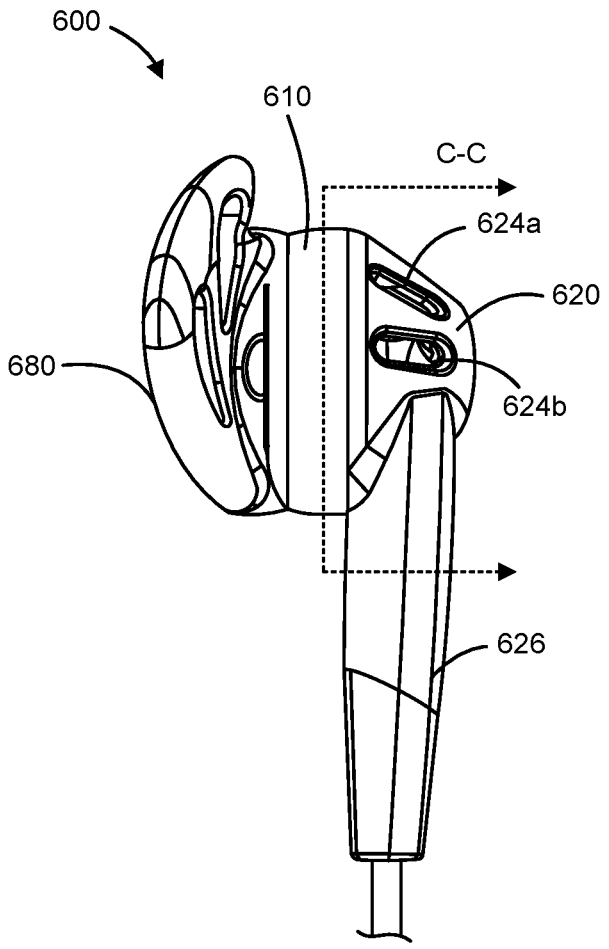
FIG. 6B shows a perspective view of the assembled waterproof earphone of FIG. 6A.
Figure 6C:
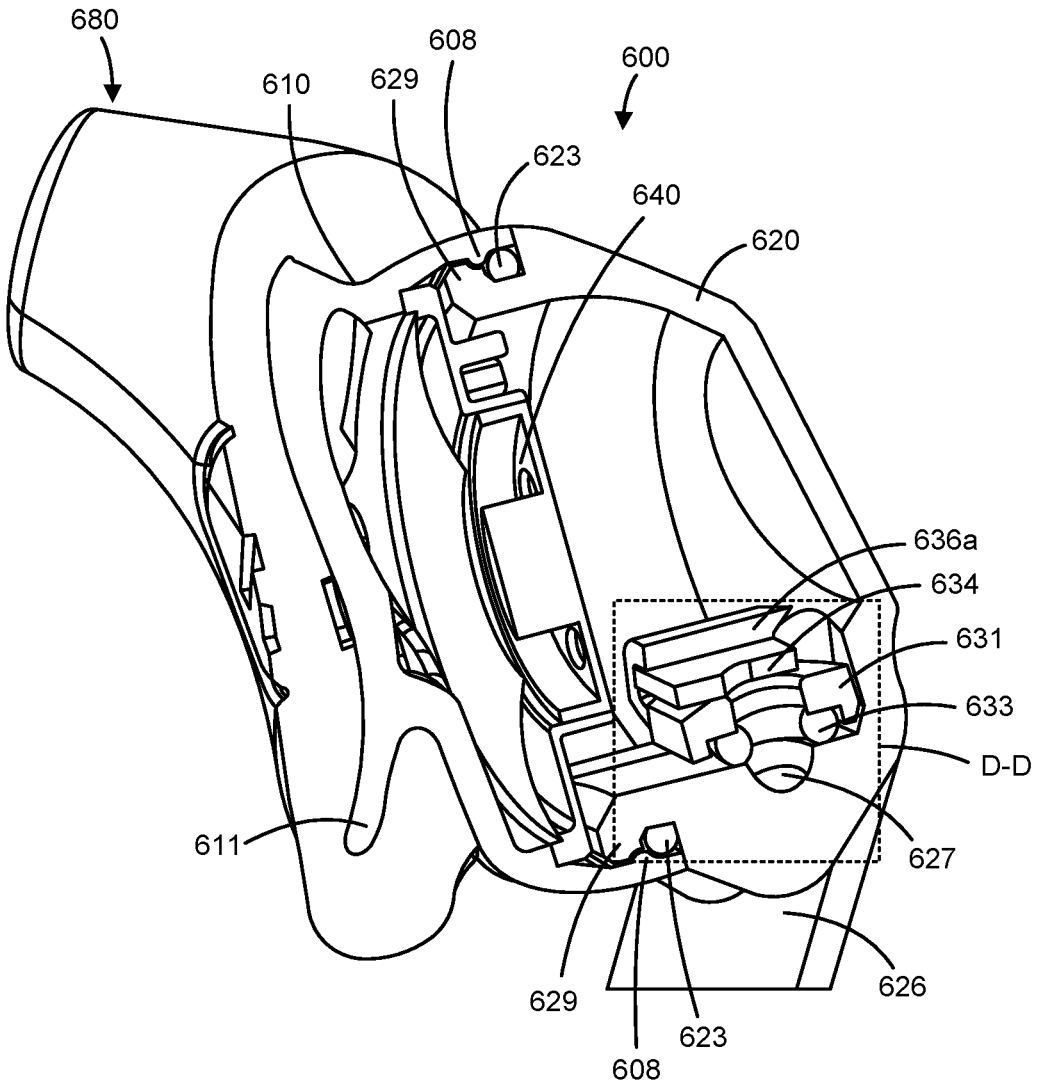
FIG. 6C shows a perspective sectional view of a partially assembled waterproof earphone assembly.

FIG. 6B shows the assembled waterproof earphone and depicts sectional plane C-C with dotted lines. FIG. 6C shows a cross-section view of an earbud 600 assembled with an eartip 680. Front member 610 may include a protrusion 608 around its circumference that interacts with protrusion 629 on the rear member to secure the front and rear members together. Seal or gasket 623 is at least partially compressed between the front and rear members to seal earbud 600 against liquid or particle intrusion at the joint between the front and rear members. Other means of securing the front member 610 to rear member 620 may be employed, such as adhesives, complementary threaded surfaces, finger latches and the like, and it will be appreciated that the seal or gasket 623 may rest in an outer-facing channel of the rear member 620 as illustrated, or may rest in a channel that faces the front member 610 to be compressed by a corresponding ridge of the front member periphery. The seal or gasket 623 may alternatively be positioned on the front member 610 in a manner similar to that described above for the rear member 620.

Cable 630 is excluded from FIG. 6C for clarity in describing a cable retention/seal assembly. The cable may extend into the earbud 600 from the interior of the strain relief cover 626 through cable hole 627. The cable is disposed through openings in both seal 633 and sealing interface element 631. Preferably, the external diameter of the cable is slightly larger than the internal diameter of the seal 633 to aid in sealing of the gasket around the cable. The external diameter of the cable may also be slightly larger than the internal diameter of the gasket holder or sealing interface element 631. When the cable has been inserted through both the gasket 633 and sealing interface element 631, compression wedge 634 is pressed into position above sealing interface element 631. Compression wedge 634 is open on one side (has a C-shaped opening) such that the wedge at least partially surrounds cable 630. Compression arms 636*a*, and 636*b*, (shown in FIG. 6E) partially surround gasket 633, sealing interface element 631, and compression wedge 634. The compression arms 636*a-b* may be formed integrally with the rear surface member, and are configured such that when compression wedge 634 is inserted in between the compression arms 636*a-b* and the sealing interface element 631, sealing interface element 631 at least partially compresses gasket 633, forming a waterproof seal between the cable 630 and the earbud 600. In some embodiments, compression arms 636*a-b* partially meet above the cable hole 627, forming a compression element with a contiguous ceiling, the ceiling having a cable aperture configured to allow the cable to extend therethrough. In certain embodiments of a compression element, the compression arms are not contiguous, but include cutouts that form an aperture that allows cable 630 to reach through. In some embodiments of a compression element, the element is at least partially formed from a firm but malleable material (e.g. copper) that may be deformed downward and pressed against the compression wedge 634 using a tool. In certain embodiments, the compression wedge may be eliminated, such that the compression element is compressed directly against sealing interface 631.

Figure 6D:
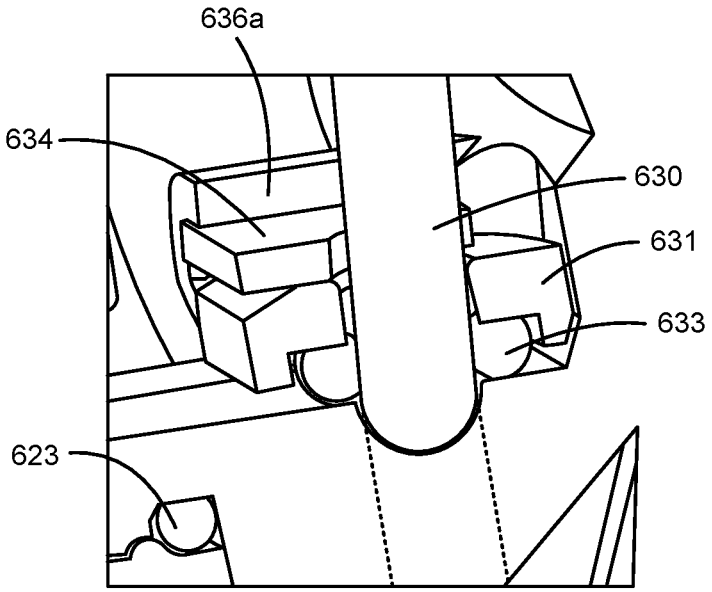
FIG. 6D shows the region of the earphone assembly where the cable enters the earphone assembly in a close-up sectional perspective view.
Figure 6E:
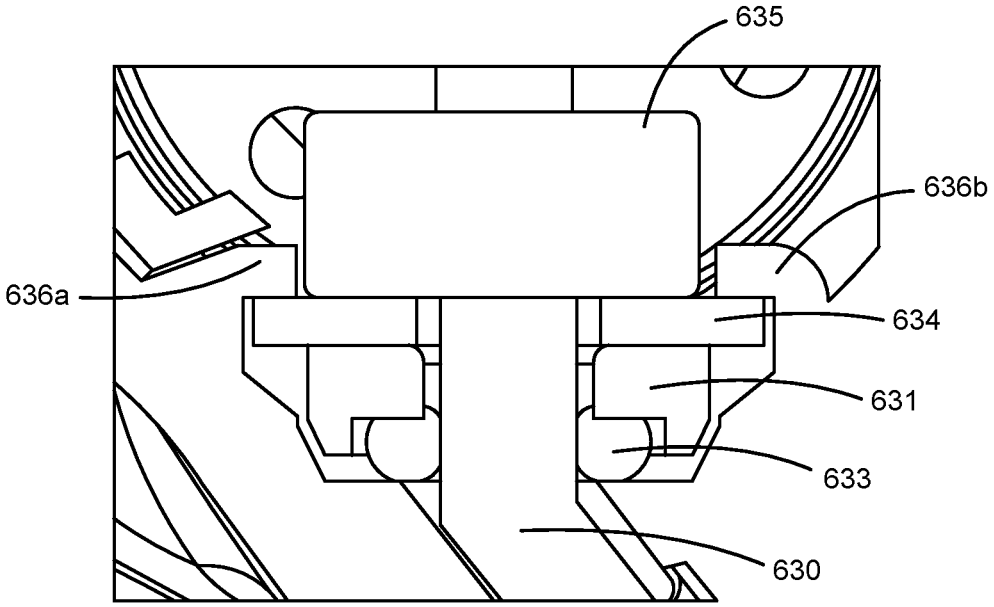
FIG. 6E depicts a side sectional view of the earphone assembly region in FIG. 6D with a crimp bead.

FIG. 6D shows a close up view of the cable retention/seal assembly labeled D-D in FIG. 6C, including the sealing interface element 631, seal 633, compression wedge 634, and compression arm 636*a*. Cable 630 is shown extending into the interior of the earphone housing. FIG. 6E is a sectional view of the cable retention/seal assembly in FIG. 6C, at a different angle from 6B (facing towards the exterior of the rear member 620 of the earbud 600). FIG. 6E depicts a crimp bead 635 that is added to cable 630 above the compression wedge in order to prevent sliding and/or removal of cable 630 from the earbud 600. The crimp bead 635 may be made of a firm but malleable material (e.g., copper), and is configured such that the cable 630 can be slid through a hole in the crimp bead, and the crimp bead is then compressed around the cable using a crimping device. In the embodiment depicted, crimp bead 635 is positioned in between the ends of compression arms 636*a-b*; however, in some embodiments, the crimp bead may have an outer diameter that is wider than that of the compression arms and the crimp bead is positioned above the compression arms.

Figure 6F:
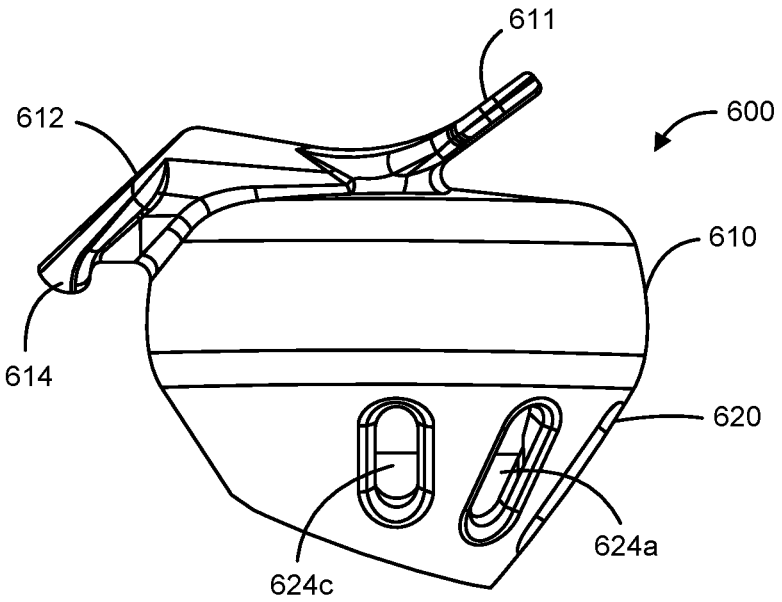
FIG. 6F shows a top view of the exterior of a waterproof earphone assembly without an attached earmold.

FIGS. 6F-6I depict exterior features of the earbud 600 and earmold 680. FIG. 6F shows a top view of a left-ear earbud 600 (the cable and strain relief cover are not visible in this view). Anchor protrusion 611 extends outward at an angle, away from the front member of the earbud housing. Anchor protrusion 611 is configured to fit into a securing cavity in an earmold (see FIG. 6H, described below); the angle at which anchor protrusion 611 is oriented (relative to the surface of the front member 610) may be: between about 85 degrees and about 10 degrees; between about 75 degrees and about 20 degrees; between about 65 degrees and about 30 degrees; between about 55 degrees and about 40 degrees; or between about 45 degrees and 40 degrees. Sound funnel or duct 612 is also configured for mating inside a funnel cavity of an earmold, and may, for that purpose, include a lip 614 that extends at least partially around the circumference of sound funnel 612. The lip 614 aids in securing an earmold to the earbud. In some embodiments, the sound duct 612 may only extend partially into a sound channel output port, allowing the remainder of the sound output port of the earmold increased compliance when contacting the anterior concha cavum and increasing the fit and comfort of the earmold in the concha cavum.

Figure 6G:
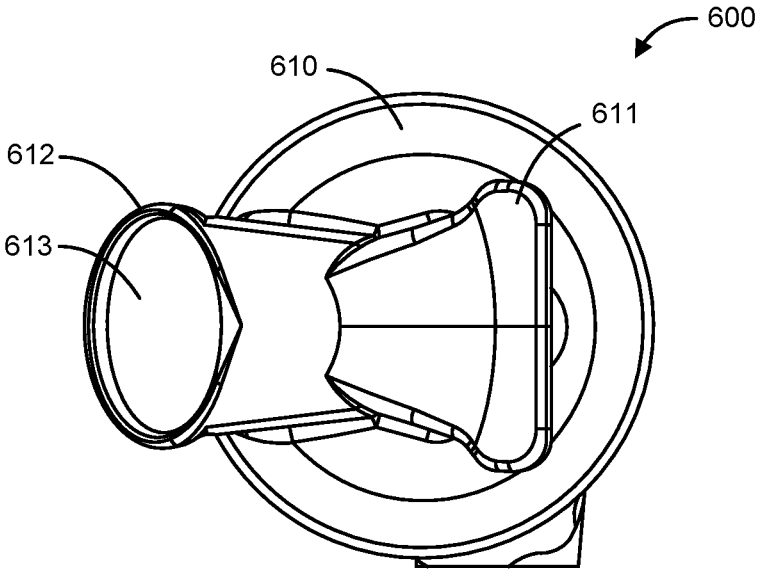
FIG. 6G depicts a side plan view of the waterproof earphone assembly facing towards the sound duct and anchor protrusion.

FIG. 6G shows a side plan view of a right-ear oriented earbud 600, facing the front member 610. Sound funnel or duct 612 and anchor protrusion 611 each flare outward as they extend from the earbud 600. The flared configuration of both the sound funnel 612 and anchor protrusion 611 aid in maintaining an earmold in position once the earmold has been attached to the earbud. The outer circumference of sound funnel 612 may be substantially round or elliptical, or other shapes; for example, in certain embodiments the sound funnel may be a polygonal shape (e.g., triangular, rectangular, pentagonal, hexagonal, etc.). Sound channel 613 may have a substantially round or elliptical circumference as shown in FIG. 6F, or it may have a circumference that is polygonal (e.g., triangular, rectangular, pentagonal, hexagonal, etc.).

Figure 6H:
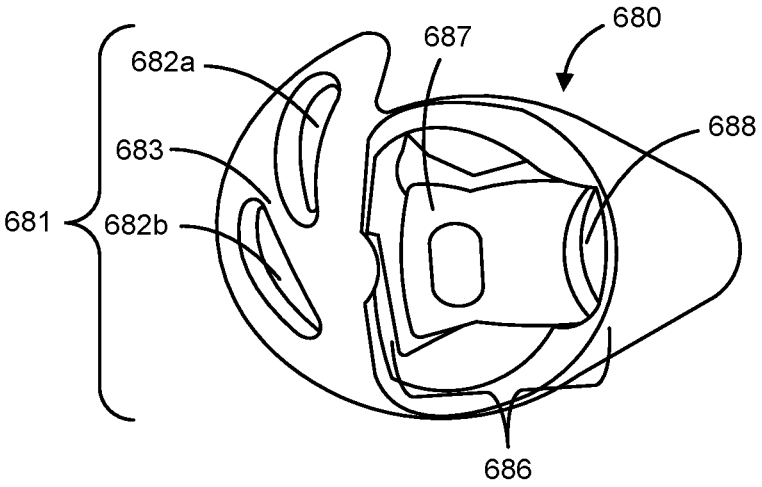
FIG. 6H shows a side plan view of an earmold facing towards the earmold cavity.

FIG. 6H depicts a side plan view of an earmold 680 facing towards the earmold cavity 686. Earmold 680 includes a posterior region 681 having holes 682*a-b* separated by a strut or rib 683 (described with respect to FIGS. 2A-2D above). Rib 683 is curved and relatively long relative to the embodiment shown in FIG. 2A, increasing the compliance of the posterior region 681. Rib 683 is angled relative to the central axis of the sound channel (compare with rib 234 of FIGS. 2A-2B). The angled rib increases compliance of the posterior region of the earmold when being inserted into a user's concha cavum and rotated backwards (described further below). The rib extends from an upper or superior region of the posterior arch (proximate the superior region of a concha cavum when the earmold is inserted) to a lower or inferior region of the main body of the earmold (proximate to a region of the main body that contacts the inferior concha cavum). In some embodiments, the rib may be angled such that it extends from a lower or inferior region of the posterior arch, up towards an upper or superior region of the main body of the earmold, thus facilitating the forward rotation of the earmold in the concha cavum in order to secure it.

The width or thickness of rib 683 (the distance between the exterior side and interior side of the earmold) may also change across a given rib's length. For example, the width of rib 683 near posterior portion 681 may be less than (or greater than) the rib's width near the body of the earmold, changing the compliance of posterior region 681. In some embodiments, the width of the rib may vary in thickness between about 1.5 mm and about 2 mm.

Figure 6I:
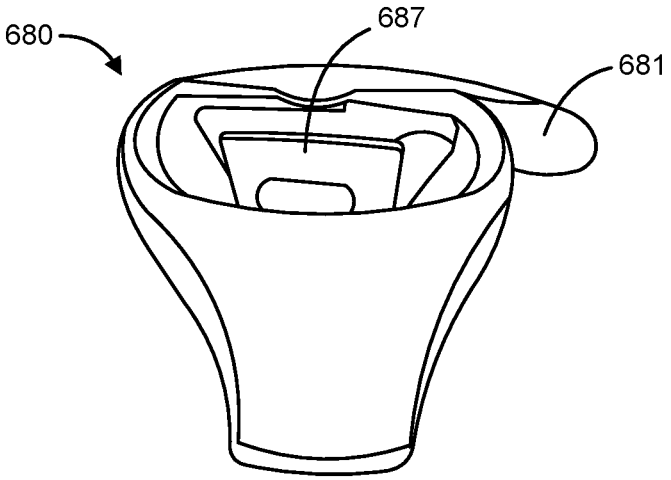
FIG. 6I shows a front view of the earmold of FIG. 6H facing towards the earmold cavity and into the securing cavity.

Cavity 686 includes a securing cavity 687 and duct cavity 688. Earmold 680 may be attached to earbud 600 (see, e.g., FIGS. 6A-B) by inserting sound duct or funnel 612 into funnel cavity 688, and then stretching the earmold 680 to pull securing cavity 687 over anchor protrusion 611 of waterproof earbud 600. FIG. 6I shows earmold 680 from a front side, facing towards the earmold cavity 686 and into securing cavity 687.

A user may insert earphones having earmolds as described herein into his or her ear by inserting the sound channel portion so that it lies proximate the entrance of the user's ear canal, and adjusting the posterior region of the earmold within the user's concha cavum. In order to ensure that the earmold is secured, the earphone may be rotated in a backwards direction within the concha cavum (using the sound channel as a pivot) such that the posterior region of the earmold moves downward towards the earlobe and away from the tragus and ear canal. This compresses the compliant posterior region of the earmold against the posterior wall of the concha cavum. This is facilitated by the slanted angle of the rib (see, e.g., rib 683 in FIG. 6H). In order to loosen the earphone and relieve the compression of the posterior region of the earmold, a user may rotate the earphone in the opposite direction such that the posterior region of the earmold rotates away from the posterior wall of the concha cavum and towards the tragus of the ear.

Multi-Function Input

In some embodiments of waterproof earphones disclosed herein, it may desirable to include a waterproof multi-function input (MFI) that includes buttons or other inputs for controlling functions of an electronic device (e.g., volume, power, play or pause, call pick-up), as well as a microphone input that allows sound input through the MFI into an attached electronic device. The MFI is in electrical communication with the electrical device. In some embodiments, the MFI may be attached inline to a cord or cable that conveys electrical audio or other signals from the electronic device to a waterproof earbud of this or other disclosures. In some embodiments, the MFI may be attached to or integrated in a frame that connects the earbuds and wrap around the top of a user's head or back of the user's neck. In certain embodiments, more than one multi-function input may be in electrical communication with the electronic device. For example, an earphone cord may include one MFI that has only a microphone, and a second MFI that is separated from the first MFI and includes volume buttons. Inputs included on an MFI may include one or more buttons (or other tactile or capacitive inputs) for volume increase and decrease, mute, play, pause, record, track skip forward and backward, fast forward, fast reverse, call control (pick up and/or hang up), and may include one or more microphones. In some embodiments the MFI may feature user inputs, such as buttons for controlling a wireless connection, such as BLUETOOTH or the like. The MFI may also include a wireless transceiver (e.g. BLUETOOTH).

Figure 7A:
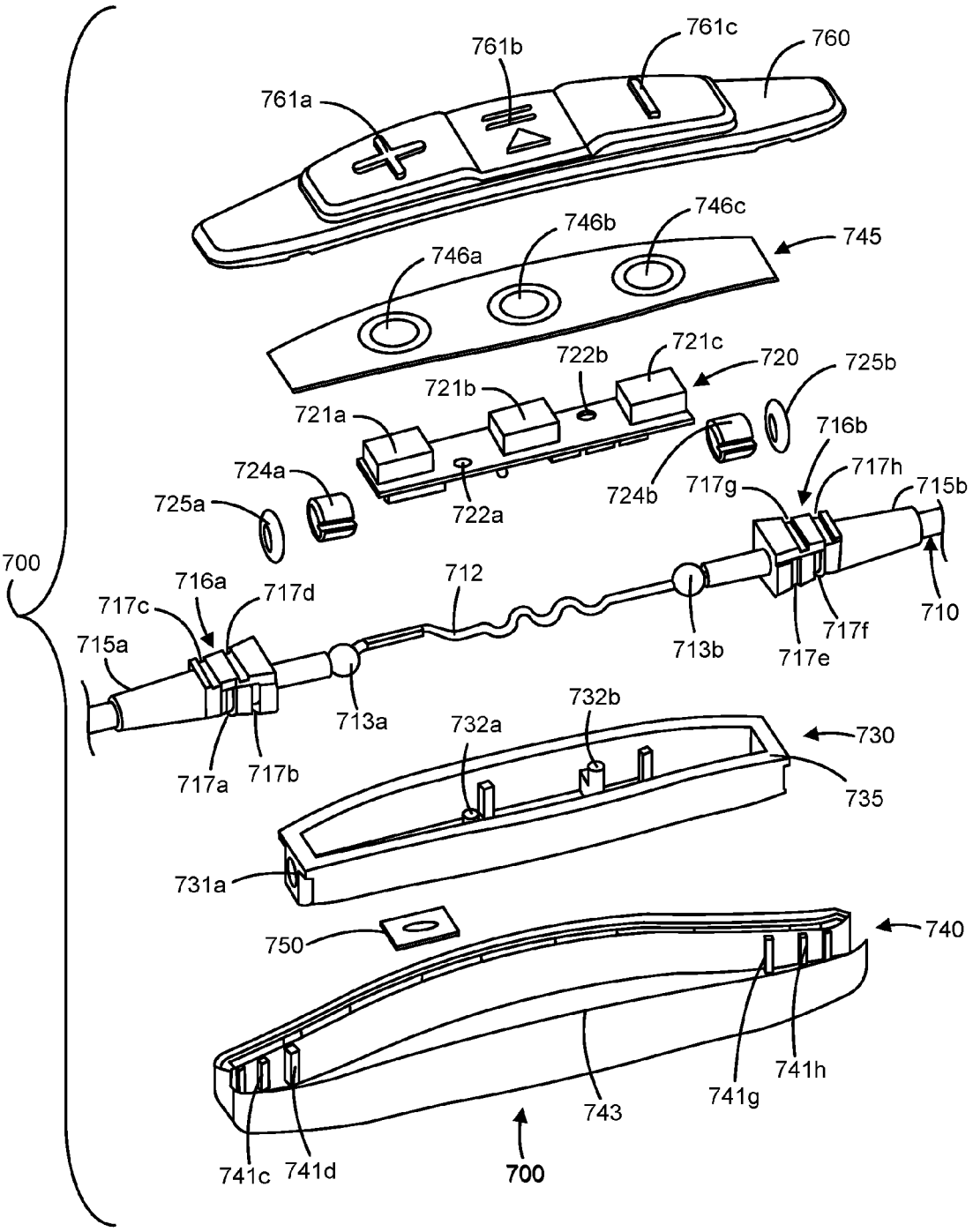
FIG. 7A shows an exploded perspective view of an exploded waterproof multi-function input (MFI) assembly.
Figure 7B:
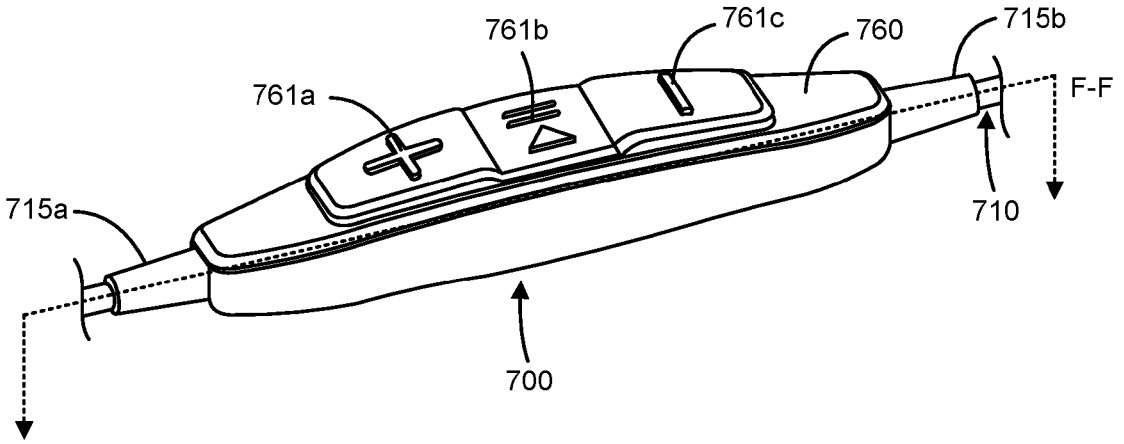
FIG. 7B shows a perspective view of the assembled MFI assembly of FIG. 7A.
Figure 7C:
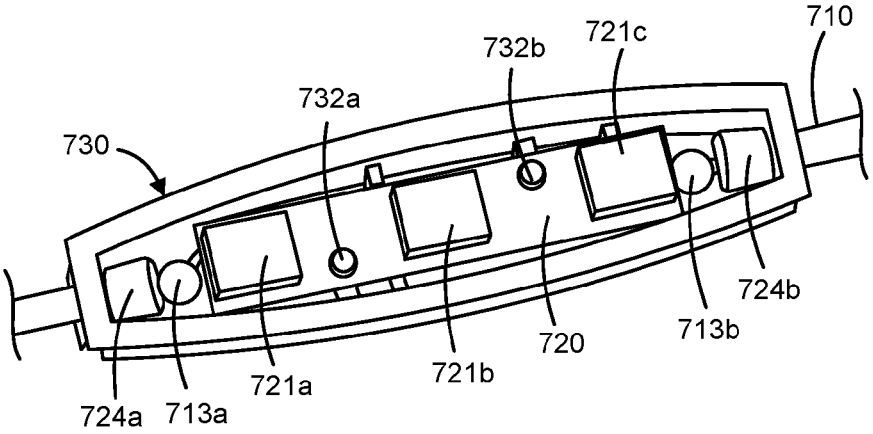
FIG. 7C shows a top view of a partially assembled MFI.
Figure 7D:
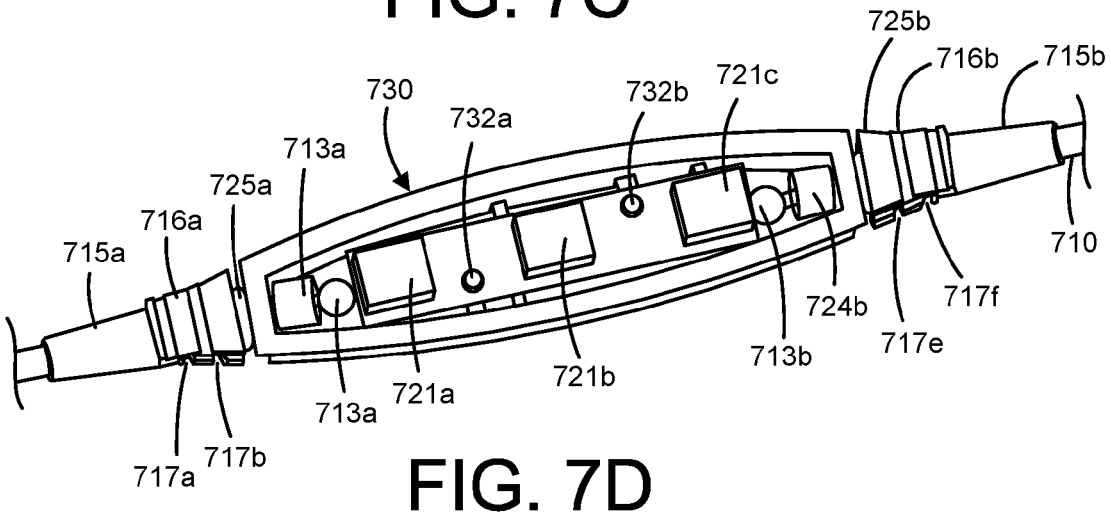
FIG. 7D shows the partially assembled MFI of FIG. 7C with additional cord strain relief members and end gaskets.

FIG. 7A shows an exploded view of an embodiment of a waterproof MFI 700. FIG. 7B shows a perspective view of assembled waterproof MFI 700, along with section F-F (see FIG. 7F). Cable 710 is positioned in an internal housing 730 and threaded through cable apertures 731*a* and 731*b* (not visible). The jacket of cable 710 is stripped away to expose the bare wire 712. Knots 713*a* and 713*b* are added to the bare wire 712 to aid in preventing the wire from slipping into the jacket. Printed circuit board assembly (PCBA) 720 is soldered to the bare wire 712 as appropriate, with different wire strands soldered to different regions of the PCBA. PCBA 720 includes buttons 721*a*, 721*b*, and 721*c*, each of which controls different aspects of a connected electronic device, such as volume increase and decrease, play, pause, etc. Alignment posts 732*a* and 732*b* extend into the interior of internal housing 730 and align with alignment holes 722*a* and 722*b* in PCBA 720; alignment posts 732 and alignment holes 722 are configured to prevent the PCBA from being placed into the internal housing in an incorrect orientation. FIG. 7C shows a perspective view of a partially assembled MFI, with PCBA 720 positioned on alignment posts 732*a-b* of internal housing 730. Knots 713*a-b* are separated from the inner surface of the internal housing by crimp beads 724*a* and 724*b*. Crimp beads 724*a-b* prevent sliding and/or removal of cable 710 from internal housing 730. Similar to the crimp beads described above for earbuds (e.g., see FIG. 6A), crimp beads 724*a-b* are made of a firm but malleable material (e.g., copper). The crimp beads 724*a-b* are configured such that the cable 710 can be slid through a hole in each crimp bead, and the crimp bead is then compressed around the cable using a pliers or other crimping device. The embodiments of FIGS. 7C and 7D show crimp beads 724*a-b* inside the internal housing. However, in some embodiments, the crimp beads may be outside of the interior housing, such as underneath strain relief covers 715*a-b*.

Figure 7E:
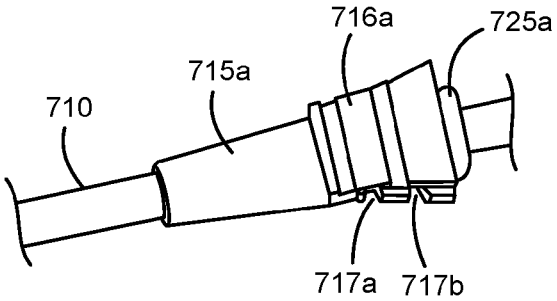
FIG. 7E shows a close-up view of a cord strain relief member and end gasket from FIG. 7D.

Returning to FIG. 7A, MFI assembly 700 includes gaskets or seals 725*a* and 725*b* that surround cable 710 proximate the cable apertures 731*a-b* on the exterior portion of the internal housing 730 and seal the cable apertures against intrusion by liquids and particles. Cable 730, positioned exterior to the internal housing, also includes anchor elements 716*a* and 716*b* that at least partially compress gaskets 725*a-b* to insure a seal sufficient to resist entry by liquids and particles. In certain embodiments, gaskets 725*a-b* may be molded directly to the surface of either the anchor elements 716*a-b* or the external surface of the internal housing 730 proximate cable apertures 731*a-b*. Internal housing 730 and anchor elements 716*a-b* are positioned in the cavity of bottom housing 740 in order to anchor the components housed in internal housing 730 and maintain a seal between anchor elements 716*a-b* and gaskets 725*a-b*. Anchor elements 716*a-b* are held in place by anchor protrusions 741*a-d* and 741*e-h* on the inner surface of bottom housing 740. Anchor protrusions 741*a-d* and 741*e-h* are configured to slide into anchor slots or grooves 717*a-d* and 717*e-h* on the sides of anchor elements 716*a* and 716*b* (anchor protrusions 741*a-b* and 741*e-f* not visible in this view). FIG. 7D shows a perspective view of a partially assembled MFI, with strain relief covers 715*a-b* and anchor elements 716*a-b* assembled onto cable 710 and abutting gaskets 725*a-b*. FIG. 7E shows a close-up view of strain relief cover 715*a*, anchor element 716*a*, and gasket 725*a* for clarity. Anchor slots 717*a-b* can also be seen (717*c-d* not visible). In some embodiments, anchor protrusions may be configured as posts, and may fit into anchor holes that extend partially or completely through the anchor elements.

Returning to FIG. 7A, the top of internal housing 730 is sealed with sealing membrane 745 that may be adhered or overmolded to the perimeter surface 735 of internal housing 730. Sealing membrane 745 may be any thin, flexible, and waterproof membrane that allows the PCBA buttons to be depressed once the MFI is assembled. Exemplary membranes may include thermoplastic polymers (e.g., polycarbonate sheets), glass, etc. In some embodiments, as shown in FIG. 7A, the sealing membrane may include button forms 746*a-c* that aid in allowing buttons 721*a-c* to be depressed when MFI 700 is assembled. Button forms may be concave and/or convex.

PCBA 720 also includes a microphone component (not shown) that permits a user to transmit sounds to a connected electronic device. Internal housing 730 and bottom housing 740 each include microphone apertures (not shown) to allow the PCBA microphone component to receive sounds. A microphone membrane 750 is positioned between the microphone apertures and adhered to the internal housing, or both the internal housing and bottom housing in order to prevent entry of liquids and particles into the internal housing. Microphone membrane 750 may be made of any waterproof membrane that is thin enough to transmit sound to the microphone component of PCBA 720, e.g., a silicone membrane or waterproof textile or mesh (woven or unwoven), described above. FIG. 7A also depicts a keypad 760 that is attached to the perimeter of bottom housing and positioned over the sealed internal housing to allow access to the buttons 721*a-c* of PCBA 720 (corresponding keypad protrusions 761*a-c*). Keypad 760 may be made from any flexible polymer, such as rubber, silicone, etc., and may be overmolded or adhered to a perimeter surface 743 of bottom housing 740. In some embodiments, the keypad 760 may be formed from a firm polymer component having an aperture surrounding the PCBA buttons and overmolded with a thermoplastic polymer, such as thermoplastic urethane or other flexible material.

Figure 7F:
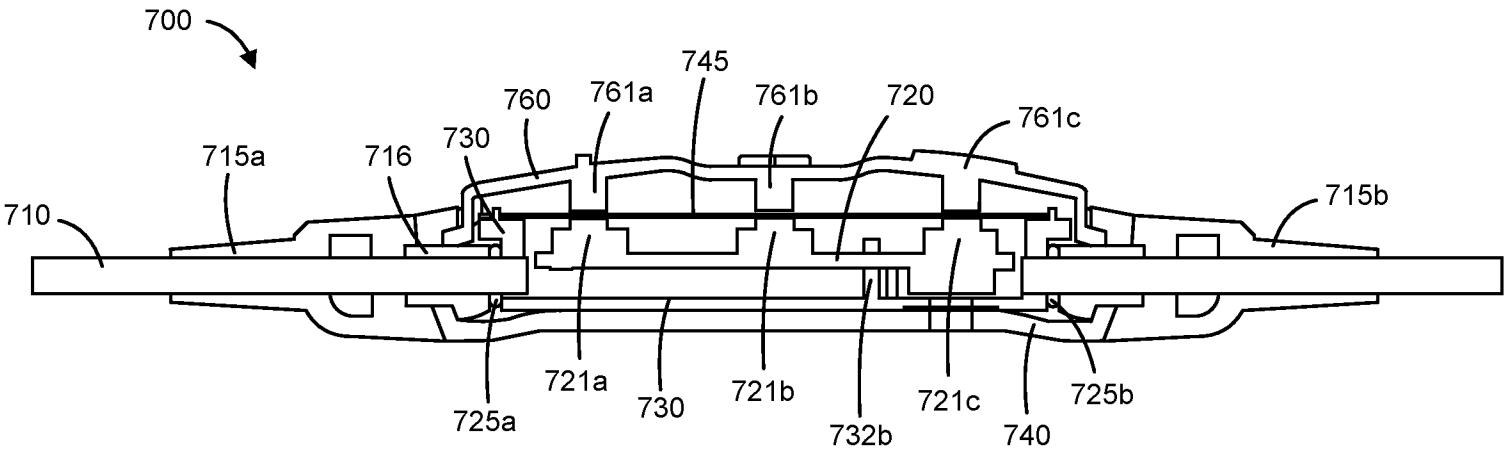
FIG. 7F shows a side sectional view of an assembled MFI.

FIG. 7F shows a cross-section of assembled MFI 700 (section F-F of FIG. 7B), including PCBA 720, internal housing 730, seals 725*a-b*, cable 710, strain relief covers 715*a-b*, anchor elements 716*a-b*, sealing membrane 745, and keypad 760. Certain elements are not visible or have been removed for clarity, such as crimp beads 724*a-b*, wire 712, knots 713*a-b*, and microphone membrane 750.

Figure 8A:
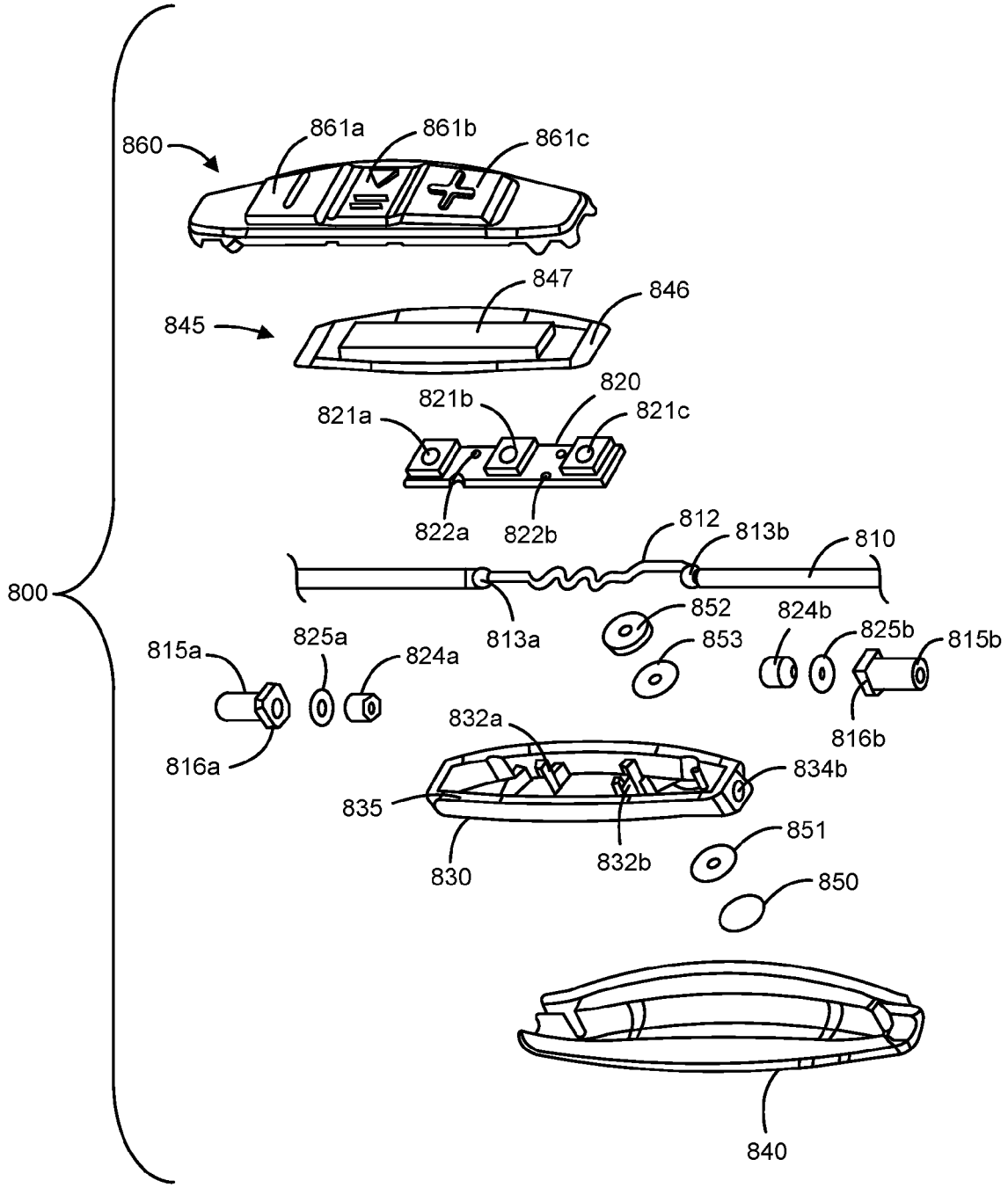
FIG. 8A depicts an exploded perspective view of an alternative embodiment of a waterproof MFI assembly.

An alternative embodiment of an MFI is depicted in FIGS. 8A-8D. FIG. 8A shows a perspective view of an exploded multi-function input 800. When MFI 800 is assembled, a portion of cable 810 extends through cable apertures 834*a* (not visible) and 834*b* of internal housing 830. Cable 810 is partially stripped, exposing wire 812 that includes knots 813*a* and 813*b*. Printed circuit board assembly (PCBA) 820 is soldered to wire 812 as appropriate. PCBA 820 includes buttons 821*a*, 821*b*, and 821*c*, each of which is configured to control volume increase, decrease, play, and pause for a connected device. PCBA 820 is aligned in internal housing 830 via alignment posts 832*a-b* of the internal housing; alignment posts 832*a-b* extend through alignment holes 822*a-b* in the internal housing. PCBA 820 includes a microphone element (not visible) that is aligned over an aperture (not visible) in the internal housing. In some embodiments, a sound gasket 852 is adhered to the exterior surface of the internal housing with an adhesive ring 851. Sound gasket 852 may be made of compressible foam that attenuates sound waves. The sound gasket may be added in order to insure that sound entering MFI 800 is efficiently directed towards the microphone element of PCBA 820, reducing sound artifacts. In an assembled MFI, crimp beads 824*a-b* are positioned in between knots 813*a-b* and the inner surface of internal housing 830 proximate cable apertures 834*a-b* (see FIGS. 8C and 8D). As described above, the crimp beads are made of a firm but malleable material (e.g., copper) and once crimped on cable 810, help prevent sliding and/or removal of cable 810 from the MFI. Crimp beads 824*a-b* are positioned in between the end of internal housing 830 and bead barriers 836*a-b* (not visible; see FIG. 8D below). This configuration may be used to ensure that the crimp bead is held in place. Gaskets 825*a* and 825 surround cable 810 proximate the cable apertures 834*a-b* on the exterior surface of internal housing 830. The gaskets are sealed using compression wedges 816*a* and 816*b*.

Figure 8B:
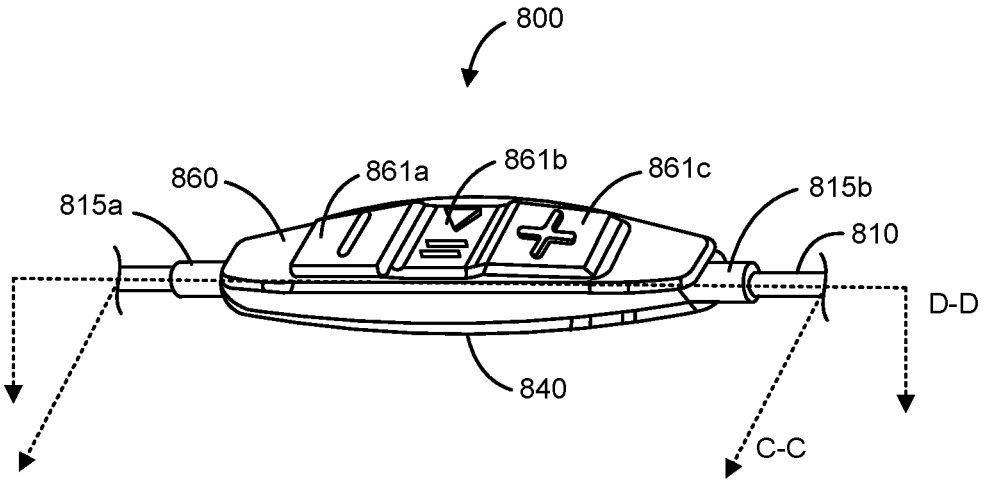
FIG. 8B shows a perspective view of the assembled waterproof MFI assembly of FIG. 8A.
Figure 8C:
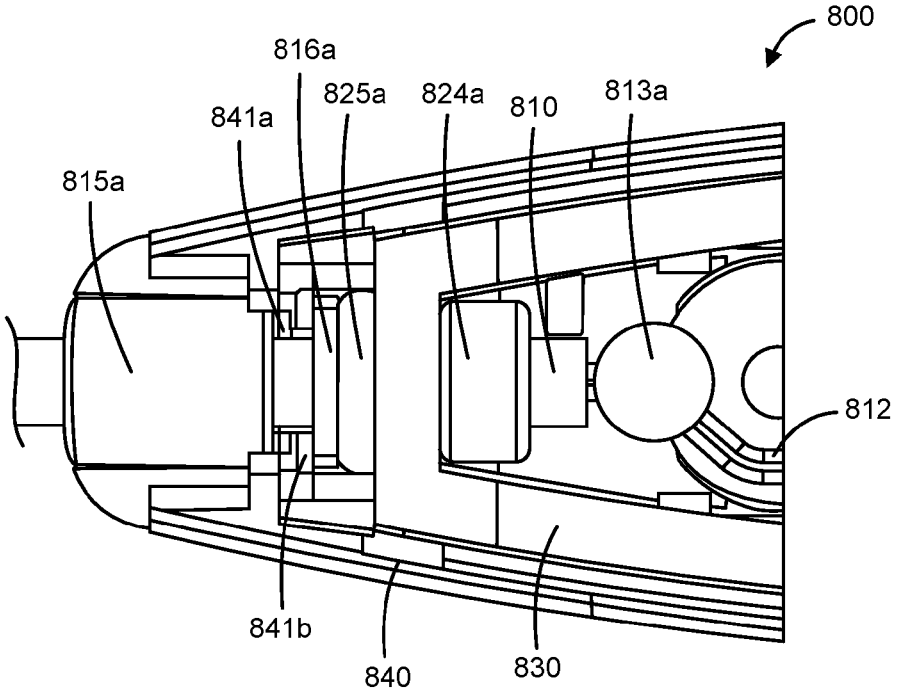
FIG. 8C shows a sectional top view of a portion of the assembled MFI of FIG. 8A.
Figure 8D:
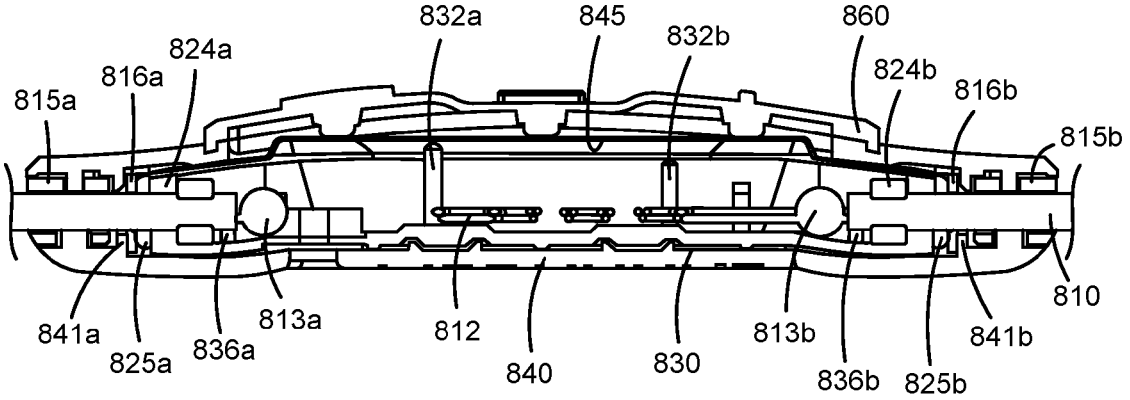
FIG. 8D depicts a side sectional view of the assembled MFI of FIG. 8A.

FIG. 8B shows a perspective view of an assembled waterproof MFI 800, and indicates sections C-C (see FIG. 8C) and D-D (see FIG. 8D). FIG. 8C shows an overhead sectional view of one end of assembled MFI 800 (section C-C of FIG. 8B). Crimp bead 824*a* is secured to cable 810 in order to prevent the cable from sliding back and forth in the MFI 800. Bottom housing 840 is configured to hold internal housing 830, and includes compression backstop elements 841*a-b* that each extend upward. Backstop elements 841*a-b* are positioned apart from seal 825*a*, to form a gap. Compression wedge 816*a* is inserted between compression elements 841*a-b* and seal 825*a* to at least partially compress seal 825*a* against the exterior surface of internal housing 830 and seal cable aperture 834*a* (not shown). In some embodiments, compression wedges 816*a-b* include a hole and are threaded onto the cable prior to assembly of MFI 800. In some embodiments, compression wedges 816*a-b* may have a C-shape, similar to that of compression wedge 634 of FIGS. 6A and 6C. Such a C-shape allows the wedges to be inserted directly while the cable is positioned in the internal housing. In certain embodiments, the compression backstop elements may be configured as compression elements formed at least partially of a firm but malleable material (e.g. copper) that may be deformed inward and pressed against compression wedge 816 using a tool.

Strain relief cover 815*a* is also shown in FIG. 8C. In certain embodiments, strain relief covers 815*a-b* may be connected with compression wedges 815*a-b*, either by adhesive or co-molding. The embodiments of FIGS. 8C and 8D show crimp beads 824*a-b* inside the internal housing. However, in some embodiments, the crimp beads may be outside of the interior housing, such as underneath strain relief covers 815*a-b*.

Returning to FIG. 8A, internal housing 830 may include an aperture (not shown) proximate the microphone element of PCBA 820. Microphone membrane 850 covers the aperture of internal housing 830, and is adhered to the exterior surface of the internal housing using adhesive ring 851. In some embodiments, the microphone membrane 850 is adhered on the interior surface of the internal housing. Internal housing 830 is sealed with top sealing member 845 that may be adhered or ultrasonically welded to perimeter surface 835 of internal housing 830. Top sealing member 845 includes a rigid perimeter frame 846 having a flexible membrane 847 positioned proximate the buttons 821*a-c* of PCBA 820. In some embodiments, internal housing may be sealed with a flexible sealing membrane (see FIG. 7A) instead of top sealing member 845. Keypad 860 is attached to bottom housing 840 (e.g., adhered or overmolded), and may be formed from a thermoplastic polymer, such as thermoplastic urethane or other flexible material.

FIG. 8D shows a side sectional view of assembled MFI 800, including crimp beads 824*a-b* and bead barriers 836*a* and 836*b* (see section D-D of FIG. 8B). Bead barriers 836*a-b* are molded into the bottom of internal housing 830 and extend into the cavity of internal housing 830. The bead barriers are configured to allow cable 810 to extend over the top edge of the bead barrier, while preventing crimp beads 824*a-b* from moving past the barrier further into the cavity of internal housing 830. In some embodiments, bead barriers 824*a-b* extend past the height of the cable 810 and attached crimp bead 824*a*, and include an aperture through which the cable can extend. In some embodiments, each of bead barriers 824*a-b* are formed from two bead barriers positioned on either side of cable 810 and include a gap through which the cable passes.

Waterproof Connector Assembly

In embodiments of the waterproof earphones described herein, it is also desirable to have a connector for plugging into the reciprocal connector of an electronic device encased in a waterproof case, and forming a waterproof seal between the connector and the waterproof encasement. While this can be securely accomplished with connection mechanism in which the connector assembly is rotated to establish a tight seal, rotating the entire connector and cable can be problematic, requiring using two hands and resulting in loops and tangles in the associated cable. The disclosed waterproof connector assembly can be rotated using only the fingers of one hand, allowing one-handed attachment, as well as minimizing the possibility of creating loops and tangles in the cable itself.

Figure 9A:
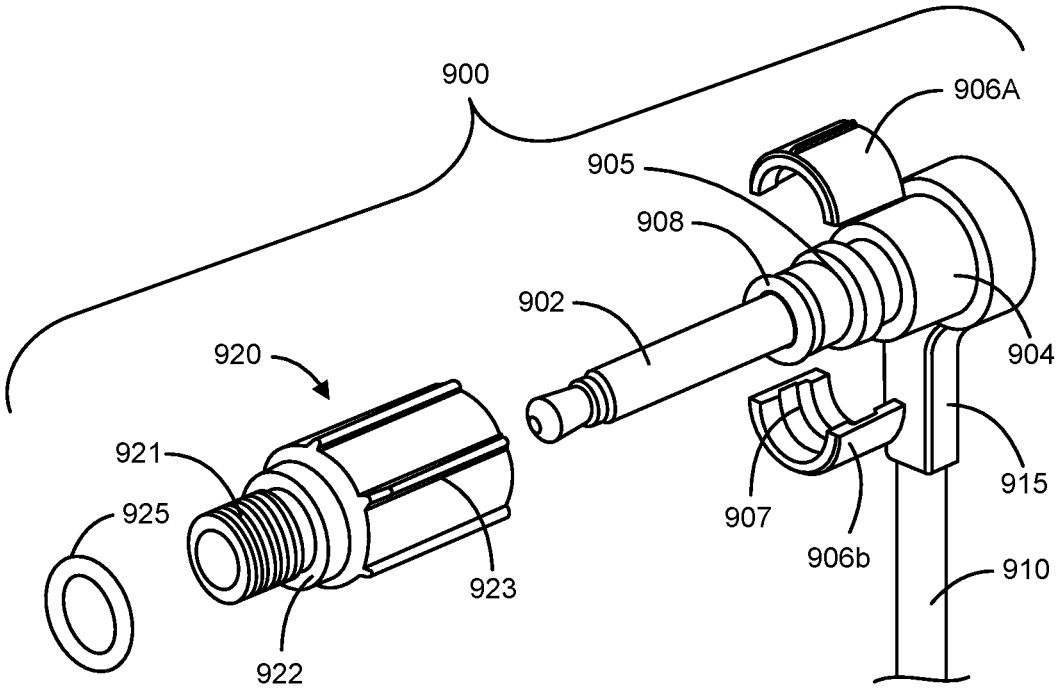
FIG. 9A depicts an exploded perspective view of a waterproof connector assembly.
Figure 9B:
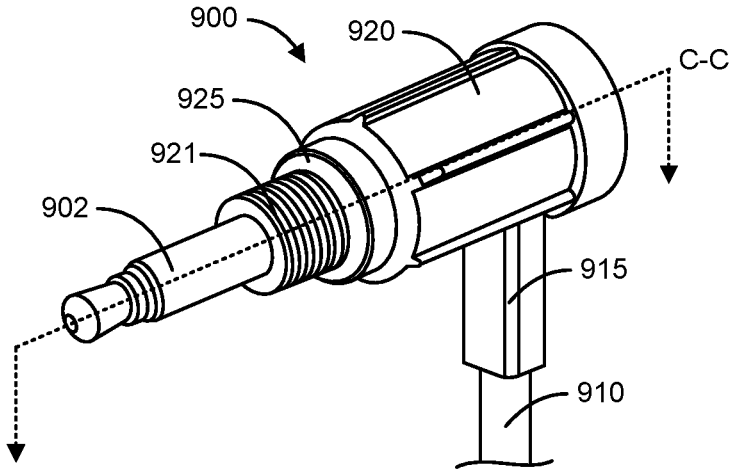
FIG. 9B shows a perspective view of the assembled connector of FIG. 9A.

In certain embodiments of the waterproof earphones, the connector may be in data communication with a wireless transceiver (e.g. BLUETOOTH). FIG. 9A shows a perspective view of an exploded waterproof connector assembly 900. Waterproof connector 900 includes a male connector 902 attached to connector body 904 and in electrical communication with cable 910 (not visible) contained within strain relief cover 915. Sleeve bearing 906 is made of two halves, 906*a* and 906*b*, that are snapped or adhered together and surround connector body 904, such that sleeve bearing 906 can freely rotate around the access of connector body 904. In some embodiments, the sleeve bearing may be made of more than two parts, or may only be a single piece. The interior surface of sleeve bearing 906 includes groove 907, configured to interact with ridge 905 on the surface of connector body 904. Groove 907 and ridge 905 are configured to interact and thereby prevent sleeve bearing 906 from sliding off of connector body 904, while allowing sleeve bearing 906 to rotate in either direction around the axis of connector body 904. In some embodiments, a ridge is formed on the inner surface of the sleeve bearing and groove is formed on the outer surface of connector body 904. Together, each of the barrier elements of the groove and ridge, regardless of location, form a barrier mechanism to prevent outer sleeve or bushing 920 from being removed from the sleeve bearing. In some embodiments, more than one pair of grooves and ridges may be utilized to prevent the outer sleeve or bushing from being removed from the connector body. Inner gasket 908 surrounds the circumference of male connector 902 and is positioned proximate the base of male connector 902 and the end of connector body 904. In some embodiments, elements capable of transmitting data and/or power, such as female connectors may be used (see, e.g., FIG. 9F). During assembly, a bushing or outer sleeve 920 may be press-fit or adhered onto sleeve bearing 906. In certain embodiments, no separate sleeve bearing is utilized, and instead a groove is formed on the interior surface of the outer sleeve. FIG. 9B shows a perspective view of an assembled waterproof connector, and indicates section C-C (depicted in FIG. 9C).

Bushing 920 also includes a threaded region 921, configured for threading into a threaded aperture in a waterproof case for an electronic device. Outer gasket 925 (e.g., an O-ring) surrounds the circumference of the bushing at the base of threaded region 921, and is positioned proximate an outer gasket seat 926. When bushing 920 is threaded into reciprocal threads of a waterproof case, outer gasket 925 is at least partially compressed against an outer sealing interface or outer gasket seat 926, forming a waterproof seal with the waterproof case. Outer gasket 925 also compresses against a sealing interface on the encasement. The encasement sealing interface may be proximate the exterior surface of the encasement or on the inner surface of a port or aperture of the encasement that receives the securing portion of the connector assembly. Inner gasket 908 is also partially compressed against an inner gasket seat or interior sealing interface (not visible in FIG. 9A) on the interior surface of bushing 920. The threaded region 921 will be substantially internal to the threaded aperture of the encasement, and the exterior surface of the bushing 920 will be substantially external to the threaded aperture of the waterproof encasement.

In some embodiments, threaded region 921 may be replaced with another rotatable securing mechanism, such as a bayonet-style securing mechanism. For example, two or more bayonet arms may extend outward from the surface of bushing 920. The bayonet arms then fit into bayonet grooves positioned in the inner surface of a connection aperture in an encasement. The bayonet grooves receive the bayonet arms and allow rotation of the bushing to secure the connector assembly to the encasement. For example, each of the bayonet grooves may have a first portion that is substantially parallel to the central axis of the case aperture, and a second portion that turns to allow rotation and securing of the bushing and connector assembly to the case. In some embodiments, the aperture of the encasement may include two or more bayonet arms, and the securing region on the distal end of the connector may include reciprocal bayonet grooves on the outside surface of the securing region. In some embodiments, more than one securing mechanism may be used. For example, both threads and bayonet arms or both threads and bayonet grooves may be used together as part of a securing region.

Figure 9C:
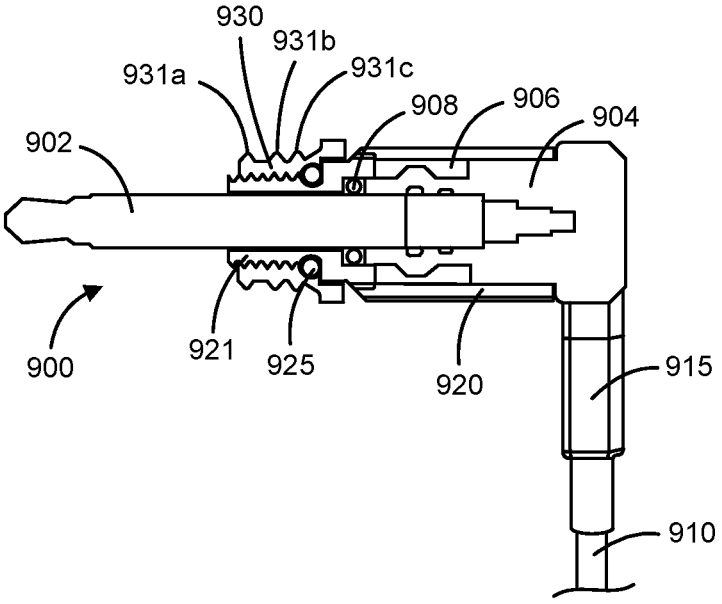
FIG. 9C shows a side sectional view of the connector assembly of FIG. 9A.
Figure 9D:
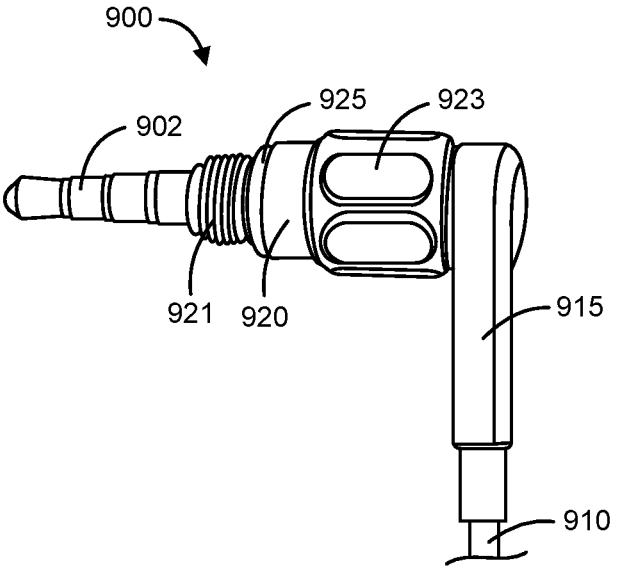
FIG. 9D shows a side view of the exterior of a waterproof connector assembly including an alternative embodiment of friction ridges on an outer sleeve or bushing.

The exterior surface of bushing 920 also includes one or more ridges 923 for providing frictional or otherwise grippable surfaces for a user's fingers, and facilitating rotation of the bushing when a user screws the waterproof connector assembly 900 into a threaded aperture. Ridges 923 may vary in number, thickness, and shape. For example, there may be 2, 3, 4, 5, 6, 7, 8 or more ridges. The ridges may be triangular, rectangular, pentagonal, hexagonal, or an irregular polygonal shape. The ridges may also be ovoid or circular. An alternative embodiment of ovoid ridges 923 is shown in FIG. 9D. In certain embodiments, inner gasket 908 may be unitary with the bushing 920 or unitary with the base of male connector 902 (e.g. overmolded). In certain embodiments, outer gasket 925 may unitary with bushing 920.

In some instances, a waterproof case for an electronic device may have a connection aperture that lacks threading configured for use with a waterproof connector assembly. In such instances, a threaded insert may be inserted into the aperture to allow a waterproof connector assembly to be threaded into the case and form a waterproof seal. FIG. 9C shows a sectional side view of waterproof connector assembly 900 screwed into a threaded insert (the waterproof case and connection aperture are not shown). Threaded insert 930 may be made of a water impermeable polymer that is semi-rigid, and includes ridges 931*a-c* that are partially compressed when threaded insert 930 is inserted into a case aperture. In some embodiments, the threaded insert 930 may be formed from a rigid polymer and adhered or welded into an aperture. In certain embodiments, the threaded insert 930 may be made of a rigid polymer overmolded with a flexible polymer, such as a thermoplastic elastomer, such that the thermoplastic elastomer can act as a seal. In some embodiments, the threaded insert may include an additional gasket on its exterior surface, in a position similar to that of gasket 925.

Figure 9E:
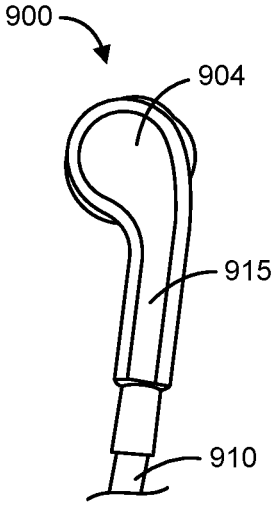
FIG. 9E shows a rear plan view of the waterproof connector assembly of FIG. 9D.

In some embodiments of the waterproof connector assembly, the central axis of the assembly may be offset from the cable, in order to facilitate rotation of the bushing with one hand. FIG. 9E depicts a plan view of the rear of waterproof connector assembly 900 in which the central axis of connector body 904 is offset from the straight line of the strain relief cover 915 and cable 910.

Figure 9F:
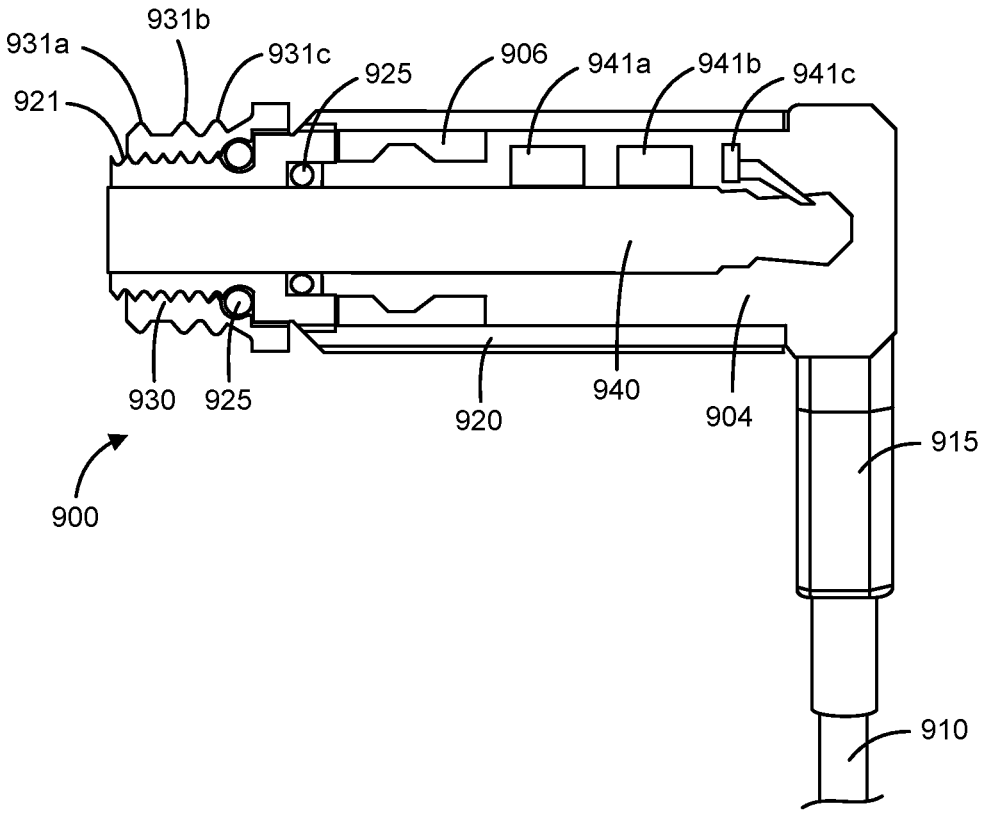
FIG. 9F shows a side sectional view of an alternative embodiment of a waterproof connector assembly that includes a female connector.

In some embodiments, waterproof connector assembly may include a female connector or socket, instead of a male connector. FIG. 9F shows a side sectional view of a waterproof connector assembly 900 that includes a female connector or socket 940 instead of a male connector. Female connector 940 includes electrical contacts 941*a*, 941 *b*, and 941*c*, configured to contact specific regions of a male connector when it is inserted into the female connector. FIG. 9F also shows the waterproof connector assembly 900 screwed into a threaded insert 930. Although not shown, the female connector of FIG. 9F may include ridges on the exterior surface of bushing 920 (see, e.g., FIGS. 9B and 9D), and are substantially external to the threaded aperture of the waterproof encasement. The threaded region 921 of the connector assembly 900 is substantially internal to the threaded aperture of the encasement when inserted therein. In certain embodiments, the female connector may extend beyond the threaded region to ensure an effective connection with the reciprocal male connector of the encased device.

Figure 10A:
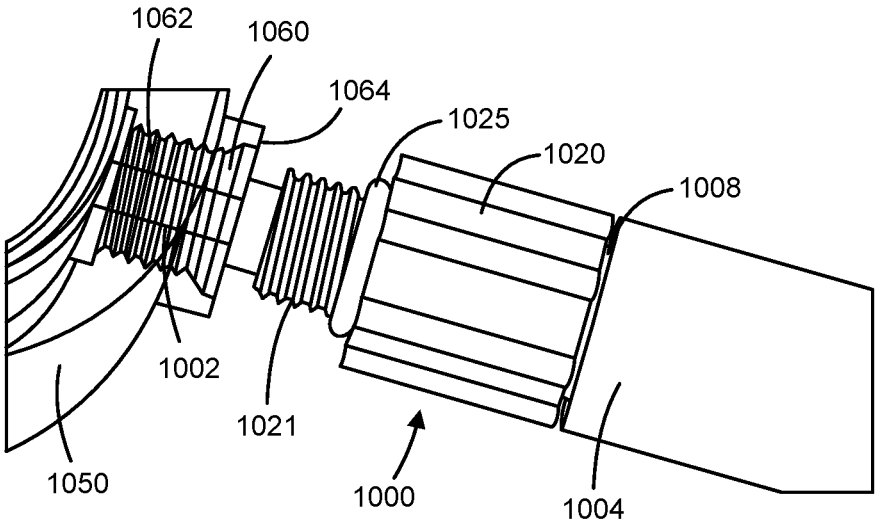
FIG. 10A shows a side view of another embodiment of a waterproof connector plug partially inserted into a threaded aperture of an encasement for an electronic device.

FIG. 10A shows an alternative embodiment of a waterproof connector assembly 1000, with male connector 1002 partially inserted into connector aperture 1060 of a waterproof case 1050. Bushing 1020 includes a threaded region 1021 having case gasket 1025 and configured to partially compress against gasket seat 1064, resulting in a waterproof seal. Connector aperture 1060 has reciprocal threads 1062, such that threaded region 1021 of bushing 1020 can screw into the connector aperture. Body gasket 1008 is positioned and partially compressed between bushing 1020 and connector body 1004, resulting in a waterproof seal.

Figure 10B:
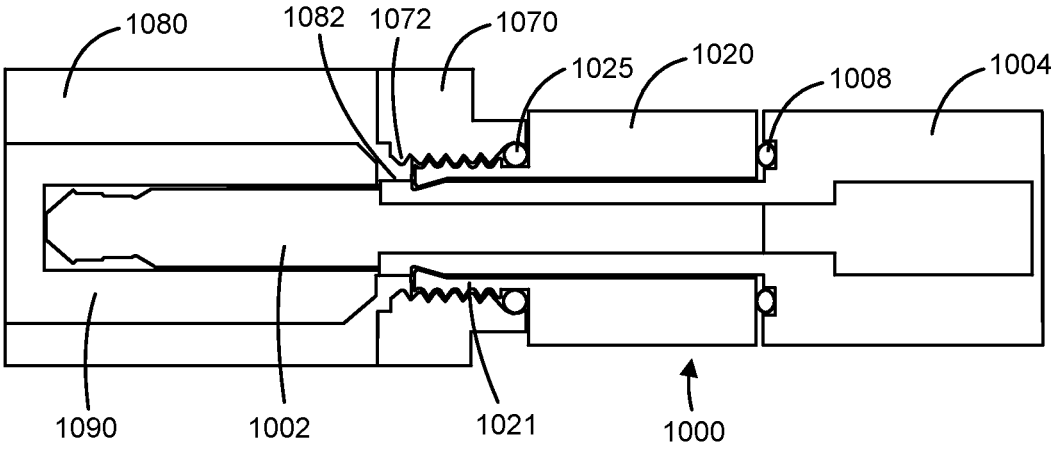
FIG. 10B shows a side sectional view of a waterproof connector assembly inserted into an externally installed adapter for a waterproof encasement.

A threaded aperture in an encasement may include threads integral to the aperture, or a threaded adapter that is inserted into the aperture from either in the interior or exterior of the encasement. FIG. 10B shows an externally installed threaded adapter that is configured to allow a waterproof case for an electronic device to receive a waterproof connector assembly. The waterproof connector assembly of FIG. 10B is the same one depicted in FIG. 10A, as well as a waterproof device case 1050 with an electrical aperture 1082 that lacks threading. An external threaded adapter 1070 includes threads 1074 on the interior portion, and is attached to the electrical aperture 1082. The threaded adapter 1070 includes a lip or protrusion 1072 configured to mate with electrical aperture 1082. In some embodiments, the external threaded adapter may be adhered or welded to device case 1080.

Figure 10C:
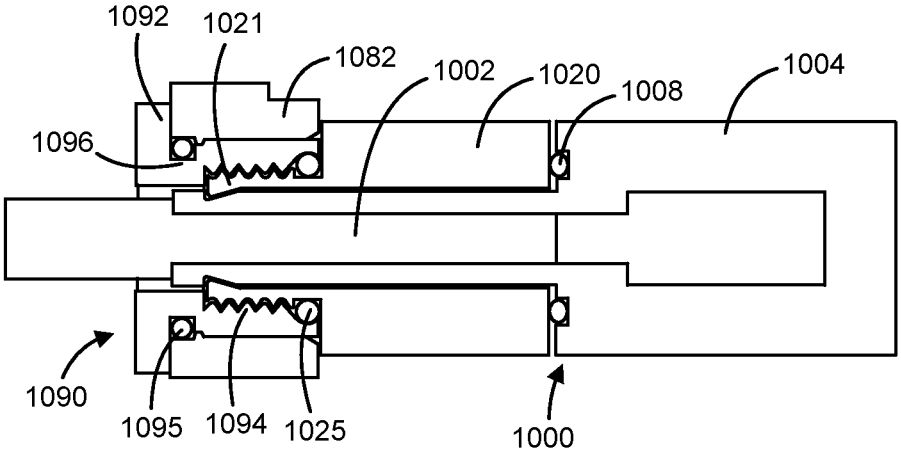
FIG. 10C is a sectional view of an alternative embodiment having a threaded adapter installed from the interior of a waterproof encasement.

FIG. 10C shows an alternative embodiment of a threaded adapter that is installed from the interior of a waterproof case 1080 into electrical aperture 1082. Waterproof connector assembly 1000 and its components are also depicted. Internal threaded adapter 1090 is installed into connector aperture 1060 from the interior of the case, and includes a flange 1092 that prevents the adapter 1090 from being pulled through electrical aperture 1082. Internal threaded adapter also includes threads 1094 that are reciprocal to the threaded region 1021. An interior gasket 1095 is positioned proximate a gasket seat 1096, and is at least partially compressed following installation. In certain embodiments, an interior gasket is not included and threaded adapter 1090 is adhered or welded to the case 1080.

Figure 10D:
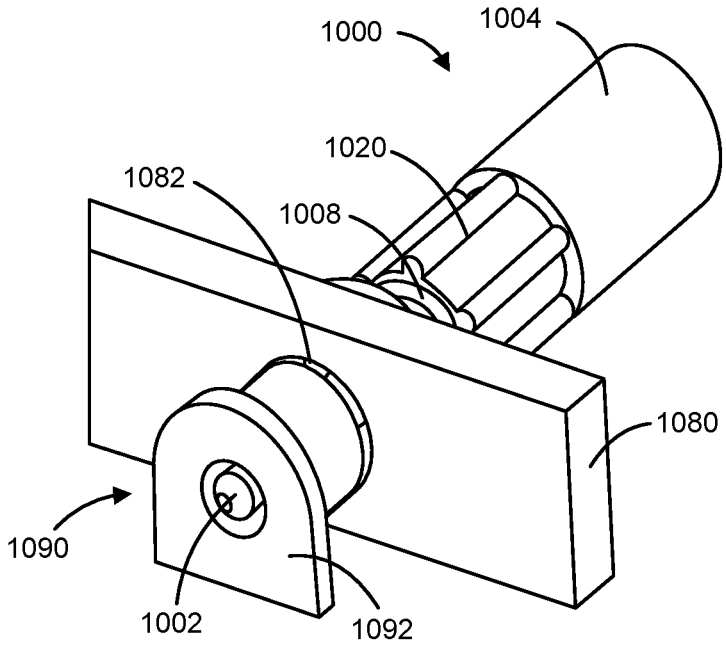
FIG. 10D shows a perspective view of a waterproof connector assembly partially inserted into an internal threaded adapter having a shaped flanged.
Figure 10E:
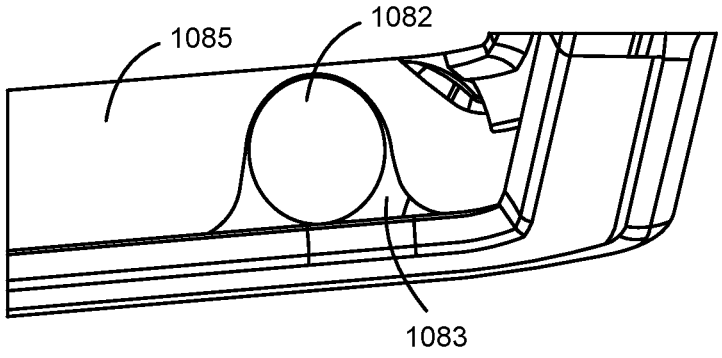
FIG. 10E depicts perspective view of a waterproof case aperture configured to accept a threaded adapter and having a shaped counterbore that accepts the shaped flange depicted in FIG. 10D.

In some embodiments of waterproof cases that utilize a threaded adapter for use with a waterproof connector assembly, it is desirable that the adapter does not rotate while the waterproof connector assembly is being screwed into the adapter. In such embodiments, the adapter may have a flange circumference shaped to prevent rotation. FIG. 10D shows a perspective view of an internal threaded adapter 1090, waterproof connector assembly 1000, and waterproof case 1080 that is partially exploded. Flange 1092 has a circumference including an arced surface on one side and straight regions on three other sides. In other embodiments, flange 1092 may have a polygonal shape that can help prevent adapter 1090 from rotating during use, such as triangular, rectangular, pentagonal, or hexagonal circumferences, as well as other irregular polygons. FIG. 10E depicts an interior surface of a waterproof case 1080 with electrical aperture 1082. Shaped counterbore 1083 is positioned proximate the circumference of electrical aperture 1082, and is configured to substantially match the circumference of the shaped flange 1092. When shaped flange 1092 is positioned within shaped counterbore 1083, the entire internal threaded adapter 1090 is prevented from rotating when a waterproof connector assembly is screwed into the adapter.

Waterproof Earphone Assembly

Figure 11:
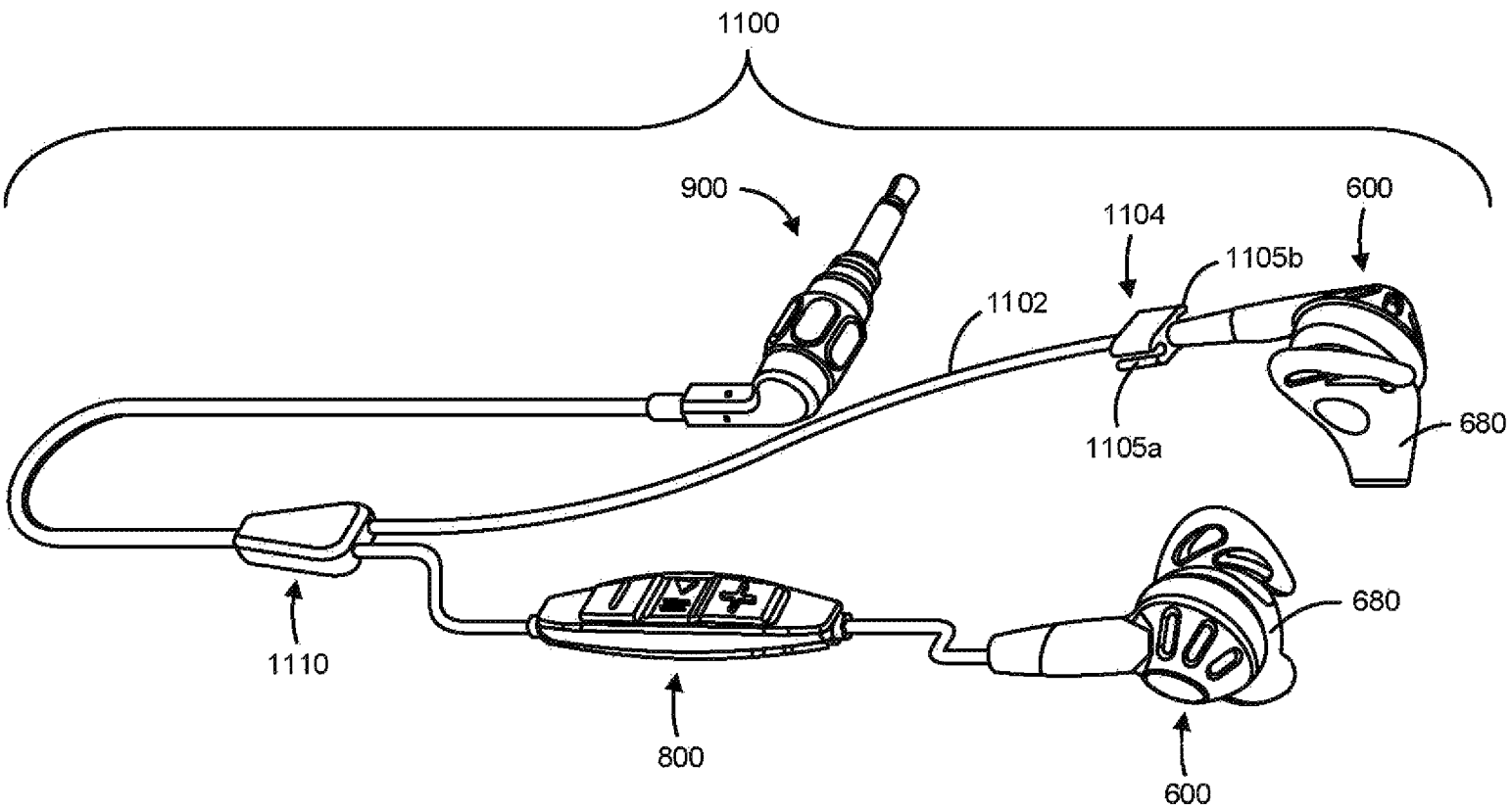
FIG. 11 shows a perspective view of a waterproof earphone assembly, including a waterproof earphone, waterproof MFI, and waterproof connector assembly.

It is desirable to combine an earmold, a waterproof earphone, waterproof MFI, and waterproof connector assembly into a combined waterproof earphone assembly or system. FIG. 11 shows a perspective view of a waterproof earphone assembly 1100, including components described above: waterproof earbud 600, waterproof MFI 800, and waterproof connector assembly 900 connected with cable 1102. Earphone assembly 1100 also includes a cable clip 1104, which includes clip elements 1105*a* and 1105*b*, each of which are configured to reversibly clip to cable 1102 and prevent tangling of cable 1102 during storage. Cable clip 1104 receives cable 1102 through an aperture during assembly of cable 1102 to earphone 600, MFI 800, and connector assembly 900, and can slide freely along cable 1102. Stereo junction 1110 includes a hard plastic body that protects the cable from deterioration where the left and right audio portions of the cable are separated. Stereo junction 1110 may be assembled from two or more portions that are adhered with waterproof adhesive or ultrasonically welded. Stereo junction 1110 may also be coated with a waterproof coating, such as plastic or silicone to form a waterproof seal where portions of the stereo junction may be joined. In some embodiments, stereo junction 1110 may be overmolded or cast in a single piece around cable 1102.

Waterproof Connector Assembly Embodiment

Figure 12:
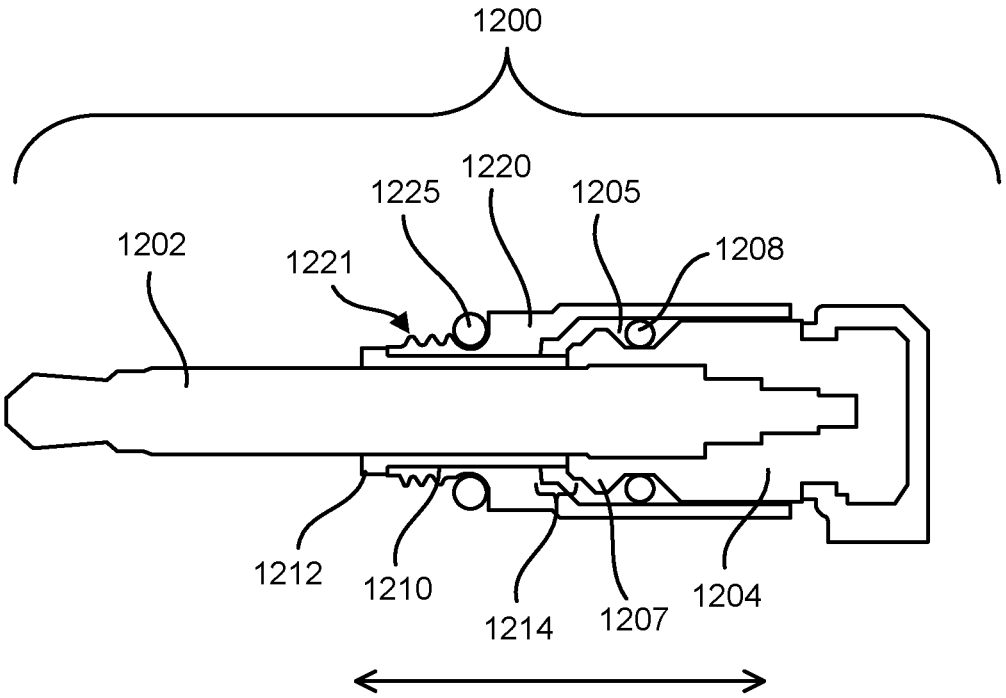
FIG. 12 shows a side sectional view of an embodiment of a connector assembly with an outer sleeve that can move axially along a portion of a connector in addition to rotating, while maintaining a waterproof connection.

FIG. 12 illustrates an embodiment of a waterproof connector 1200 with a rotatable outer sleeve that can slide along part of a central axis of the connector, as well as rotate around the connector body to allow attachment to an encasement. Different devices with different dimensions may require different case configurations, resulting in a range of distances between a connector aperture in the case and the connection interface of the encased device. A connector assembly with a sliding outer sleeve allows the connector assembly to be used with multiple cases and/or devices having a variety of distances from the case aperture to the device connection interface.

Connector body 1204 holds a portion of male connector 1202. In some embodiments, the connector may be female. Inner sleeve 1210 is adhered to male connector 1202, and includes a flange or slide stop 1212. Outer sleeve 1220 is in contact with inner sleeve 1210 but can freely rotate. In some embodiments, the inner sleeve and outer sleeve may include one or more detent features. The detent features may include one or more protrusions on both the inner surface of the outer sleeve and the surface of the connector body. The protrusions provide some mechanical resistance against rotation of the outer sleeve, which can be overcome by a user exerting additional force on the outer sleeve, resulting in the protrusions moving past each other. In some embodiments, the detent features may include protrusions and reciprocal grooves.

Connector body 1204 includes a shoulder 1207 underneath outer sleeve 1220. The distance between shoulder 1207 and slide stop 1212 is greater than that of the portion of outer sleeve 1220 that lies between them, leaving a gap 1214. Thus, outer sleeve 1220 can both rotate around the circumference of the male connector 1202, as well as slide parallel to the central axis of male connector 1202, as shown by the double-headed arrow in FIG. 12. The size of the gap can be adjusted by adjusting the length of the portion of outer sleeve 1220 and/or the distance between the slide stop 1212 and shoulder 1207. Although inner sleeve 1210 is depicted as a separate piece in FIG. 12, in some embodiments, no inner sleeve is used and the connector body itself may include a slide stop in addition to shoulder 1207.

Connector body 1204 includes a groove or channel 1205 that contains an interior seal or interior gasket 1208. Channel 1205 and interior gasket 1208 circumscribe the outer surface of connector body 1204 and are configured such that interior gasket 1208 forms a seal with the inner surface of outer sleeve 1220, as well as with channel 1205 of connector body 1204. Interior gasket 1208 may be a separate unit or may be overmolded into channel 1205. The size and hardness of interior gasket 1208 may be adjusted to allow outer sleeve 1220 to rotate around inner sleeve 1210, while still providing a radial watertight seal between outer sleeve 1220 and connector body 1204. While channel 1205 has straight, non-perpendicular sides creating a wide opening at the top of the channel, in some embodiments, the sides of channel 1205 are perpendicular and configured to contact the sides of interior gasket 1208. This can prevent interior gasket 1208 from rolling out of channel 1205 when outer sleeve 1220 is slid back and forth along inner sleeve. In some embodiments, channel 1205 may have an opening that is slightly smaller than the width of the channel's interior. The gasket may be formed from an elastomeric material and pressed into channel 1205 so that it is maintained inside the channel but partially emerges from the channel to provide a seal against outer sleeve 1220. In some embodiments, the geometry of channel 1205 is shaped to match the curvature of gasket 1208 to maximize surface area contact with the gasket and minimize the possibility of water leakage between the channel and gasket.

Outer sleeve 1220 also includes a threaded region 1221 on its distal end that is used to partially or completely enter a case aperture having reciprocal threads. In some embodiments, the threaded region may be replaced with two or more bayonet arms that fit into reciprocal bayonet grooves on a case connection port, to allow removable attachment. Exterior gasket 1225 is positioned proximate threaded region 1221 to form a seal between outer sleeve 1220 and a case when the connector assembly is attached.

The disclosure herein provides various aspects of a waterproof earphone, earmold, connector, and multi-function input. These components can be together in an earphone or separately. In one aspect, the disclosure describes a connector assembly for providing a waterproof connection to an encasement for an electronic device, the waterproof connection providing access to a connection interface of the electronic device. The connector assembly includes a connector body coupled with a cable. The cable to convey at least one of data and power between the connector body and the connection interface of the electronic device. The connector assembly includes a transmission element coupled to the connector body, the transmission element to engage with the connection interface of the encased electronic device and enable transmission of at least one of the data and power between the electronic device and the cable. The connector assembly also includes an outer sleeve surrounding a portion of the connector and interfacing with the connector body, the outer sleeve to rotate around the transmission element and secure the connector assembly to the encasement. The outer sleeve has a distal end, a proximal end, an outer surface, and an inner surface, and a securing region on the distal end of the outer sleeve. The securing region secures the connector assembly with the encasement when the outer sleeve is rotated around the connector element. The connector assembly also includes an inner sealing interface on the inner surface of the outer sleeve and an inner gasket positioned proximate the inner sealing surface and around a circumference of the connector body to seal between the inner sealing interface and the connector body. The connector assembly further includes an outer sealing interface proximate the securing region on the outer surface of the outer sleeve and an outer gasket positioned proximate the outer sealing interface and positioned around a circumference of the outer sealing interface. The outer gasket seals the securing region with the encasement when the outer sleeve is engaged with the encasement.

In certain embodiments of the foregoing aspect, the connector assemblies may also include a first barrier element on the outer surface of the connector body and a second barrier element on the inner surface of the outer sleeve. The second barrier element interfaces with the first barrier mechanism and prevent removal of the outer sleeve from the connector body while allowing rotation of the outer sleeve around the connector element.

In another aspect, the disclosure provides a connector assembly with a sleeve bearing. Such a connector assembly includes a connector body coupled with a cable, the cable for conveying at least one of data and power to and from the connection interface of the electronic device. The connector assembly also includes a transmission element attached to the connector body. The transmission element engages with the connection interface of the encased electronic device and enables transmission of at least one of the data and power between the electronic device and the cable. Further included is a sleeve bearing having an outer surface and an inner surface rotatably interfaced with the external surface of the connector body. An outer sleeve is affixed to an outer surface of the sleeve bearing. The outer sleeve rotates around the transmission element and secures the connector assembly to the encasement. The outer sleeve has a distal end, a proximal end, an outer surface, and an inner surface, as well as a securing region on the distal end of the outer sleeve, the securing region to secure the connector assembly with the encasement when the outer sleeve is rotated. The connector assembly also includes a first barrier element on the outer surface of the connector body and a second barrier element on the inner surface of the sleeve bearing. The second barrier element interfaces with the first barrier element and prevents removal of the outer sleeve from the connector body while allowing rotation of the outer sleeve around the connector body. Further included is an inner sealing interface on the inner surface of the outer sleeve and an inner gasket positioned proximate the inner sealing surface and around a circumference of the connector body to seal between the inner sealing interface and the connector body. The connector assembly also includes an outer sealing interface proximate the securing region on the outer surface of the outer sleeve and an outer gasket positioned proximate the outer sealing interface and positioned around a circumference of the outer sealing interface, the outer gasket to seal the securing region with the encasement when the outer sleeve is engaged with the encasement.

In yet another aspect, the disclosure provides a connector assembly that has a sliding outer sleeve. The connector assembly includes a connector body coupled with a cable, the cable to convey at least one of data and power to and from the connection interface of the electronic device. Further included is a transmission element attached to the connector body, the transmission element to engage with the connection interface of the encased electronic device and enable transmission of at least one of data and power between the electronic device and the cable. The connector assembly includes an outer sleeve coupled with an outer surface of the connector body, the outer sleeve able to slide an axial distance along the connector body and to rotate around the connector body. The outer sleeve has a distal end, a proximal end, an outer surface, and an inner surface, as well as a securing region on the distal end of the outer sleeve. The securing region secures with the encasement when the outer sleeve is rotated around the transmission element. The connector assembly includes a shoulder on a proximal portion of the connector body and a slide stop on a distal portion of the connector body. The shoulder and slide stop to prevent removal of the outer sleeve from the connector body while allowing rotation of the outer sleeve around the connector body. Further included is a channel on the outer surface of the connector body and an inner gasket positioned in the channel. The inner gasket forms a seal between the connector body and the inner surface of the outer sleeve. The connector assembly also includes an outer sealing interface proximate the securing region on the outer surface of the outer sleeve, as well as an outer gasket positioned proximate the outer sealing interface. The outer gasket seals the securing region with the encasement when the outer sleeve is engaged with the encasement.

In still another aspect, the disclosure provides a connector assembly that has a sliding outer sleeve and an inner sleeve with a slide stop. The connector assembly includes a connector body coupled with a cable, the cable to convey at least one of data and power to and from the connection interface of the electronic device. Also included is a transmission element attached to the connector body. The transmission element engages with the connection interface of the encased electronic device and enables transmission of at least one of data and power between the electronic device and the cable. Further included is an outer sleeve coupled with an outer surface of the connector body. The outer sleeve is able to slide an axial distance along the connector body and to rotate around the connector body. The outer sleeve has a distal end, a proximal end, an outer surface, and an inner surface, as well as a securing region on the distal end of the outer sleeve. The securing region secures with the encasement when the outer sleeve is rotated around the transmission element. Also included is an inner sleeve non-rotatably coupled with at least one of the outer surface of the transmission element and the outer surface of the connector body. The inner sleeve has a proximal end, a distal end, and an outer surface. A shoulder is included on a proximal portion of the connector body and a slide stop around at least a portion of the distal end of the circumference of the inner sleeve. The shoulder and slide stop prevent removal of the outer sleeve from the connector body while allowing rotation of the outer sleeve around the connector body. Also included with the connector assembly is a channel on the outer surface of the connector body and an inner gasket positioned in the channel. The inner gasket forms a seal between the connector body and the inner surface of the outer sleeve. The connector assembly also includes an outer sealing interface proximate the securing region on the outer surface of the outer sleeve and an outer gasket positioned proximate the outer sealing interface. The outer gasket seals the securing region with the encasement when the outer sleeve is engaged with the encasement.

In some embodiments of the foregoing connector assemblies, the first barrier element is a ridge and the second barrier element is a groove. In some embodiments, the first barrier element is a groove and the second barrier element is a ridge.

In some embodiments of a connector assembly, the securing region includes threads to engage corresponding threads of the encasement when the connector assembly is engaged with the encasement. In some embodiments, the securing region comprises two or more bayonet arms to engage corresponding grooves of the encasement when the connector assembly is engaged with the encasement. In certain embodiments, the securing region includes two or more grooves to engage corresponding bayonet arms of the encasement when the connector assembly is engaged with the encasement.

In some embodiments of a connector assembly, the transmission element may be a male pin or a female socket.

The instant disclosure also provides for earmolds for fitting within a concha cavum of an ear and transmitting sound from a headphone. The earmolds include a main body shaped to interface with an anterior concha cavum, an inferior concha cavum, and a posterior concha cavum of an ear. Further included is a sound channel on the main body that extends toward the anterior concha cavum of an ear. The earmold includes a posterior arch on the main body opposite the sound channel to compress against a posterior concha cavum. Included with the posterior arch is at least one rib extending between posterior arch and the main body, the rib being angled relative to the central axis of the sound channel. The earmold is formed from an elastomeric material.

In some embodiments of the earmold, the at least one rib extends from a superior region of the posterior arch to an inferior region of the main body. In some embodiments, the main body of the earmold also includes a securing cavity opposite the sound channel.

The instant disclosure also provides housings and assemblies for electronic components. In one aspect, an electronic component assembly includes one or more electronic components housed in an internal housing. The internal housing includes at least one internal housing aperture and at least one gasket seat on an outside surface of the internal housing and proximate the internal housing aperture. The electronic assembly includes a cable to the one or more electronic components and inserted through the internal cable aperture. In some embodiments, the cable has at least one of electrical or optical connectivity. Further included with the electronic component assembly is an external housing configured to house the internal housing. The external housing has an interior surface and an exterior surface, as well as an external cable aperture through which the cable extends. The external housing also includes at least one anchor protrusion extending into the interior of the external housing. The electronic component assembly also includes an anchor element surrounding the circumference of the cable, and having a proximal end portion, a distal end portion, and at least three side portions. A gasket is also included with the electronic component assembly. The gasket surrounds the cable and is at least partially compressed between the interior surface of the internal housing proximate the internal cable aperture and the proximal end portion of the anchor element to seal the internal housing.

In another aspect, the instant disclosure provides an electronic component assembly. The component assembly includes one or more electronic components housed in an internal housing having at least one internal cable aperture, an internal surface, and an external surface. Also included is a cable having electrical or optical connectivity to the one or more electronic components and inserted through the internal cable aperture. The assembly includes an external housing configured to house the internal housing. The external housing has an interior surface and an exterior surface, as well as an external cable aperture through which the cable extends, and a compression backstop extending into the interior of the housing. The component assembly also includes a gasket surrounding the cable that is at least partially compressed between the exterior surface of the internal housing proximate the internal cable aperture and the compression backstop.

In certain embodiments of the foregoing aspects of component assemblies, a compression wedge is included that at least partially surrounds the circumference of the cable, and is positioned in between the compression backstop and the gasket.

In some embodiments of the electronic component housings above, the anchor element includes at least one slot in a side portion. The anchor element interacts with the anchor protrusions and preventing the anchor element from sliding within the housing. In some embodiments, the anchor element includes at least one hole that can receive an anchor protrusion when the anchor protrusion is configured as a post.

In some embodiments of the electronic component housing, a crimp bead is also included that securely surrounds the circumference of the cable to prevent the cable from moving in and out of the component housing. In certain embodiments, the crimp bead is proximate the interior surface of the internal housing.

In some embodiments of the electronic component housings described herein, the one or more electronic components may include one or more of: an earphone assembly for producing sound, a microphone assembly for detecting sound, at least one button to control an electronic device, and at least one display for displaying information from an electronic device.

The above figures and description may depict exemplary configurations for an apparatus of the disclosure, which is done to aid in understanding the features and functionality that can be included in the housings described herein. The apparatus is not restricted to the illustrated architectures or configurations, but can be implemented using a variety of alternative architectures and configurations. Additionally, although the apparatus is described above in terms of various exemplary embodiments and implementations, it should be understood that the various features and functionality described in one or more of the individual embodiments with which they are described, but instead can be applied, alone or in some combination, to one or more of the other embodiments of the disclosure, whether or not such embodiments are described and whether or not such features are presented as being a part of a described embodiment. Thus the breadth and scope of the present disclosure, especially in any following claims, should not be limited by any of the above-described exemplary embodiments.

The contents of the articles, patents, and patent applications, and all other documents and electronically available information mentioned or cited herein, are hereby incorporated by reference in their entirety to the same extent as if each individual publication was specifically and individually indicated to be incorporated by reference. Applicants reserve the right to physically incorporate into this application any and all materials and information from any such articles, patents, patent applications, or other physical and electronic documents.

Terms and phrases used in this document, and variations thereof, unless otherwise expressly stated, should be construed as open ended as opposed to limiting. As examples of the foregoing: the term "including" should be read to mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent. Additionally, where a range is set forth, the upper and lower limits of the stated range include of all of the intermediary units therein.

The foregoing description is intended to illustrate but not to limit the scope of the disclosure, which is defined by the scope of the appended claims. Other embodiments are within the scope of the following claims.

What is claimed:

1. A connector assembly for providing a waterproof connection to a case for an electronic device at an aperture of the case and for providing an electrical connection to an electrical interface of the electronic device when the electronic device is installed in the case, the connector assembly comprising:

a connector body including a first barrier element on an outer surface of the connector body;

an electrical cable attached to the connector body;

an electrical conductor at least partially contained in the connector body and electrically connected to the electrical cable, the electrical conductor configured to electrically engage the electrical interface of the installed electronic device through the aperture of the case to convey at least one of data and power between the installed electronic device and the electrical cable when the connector assembly is removably connected to the case; and an outer sleeve surrounding at least a portion of the connector body, the outer sleeve configured to freely rotate around the connector body when the connector assembly is being connected to the case and further configured to removably connect the connector assembly to the case at the aperture, the outer sleeve comprising:

a securing region on a first end of the outer sleeve to removably secure the connector assembly to the case when the outer sleeve is rotated around the connector body, the securing region comprising threads to engage corresponding threads of the case when the connector assembly is connected to the case;

an inner gasket positioned to seal an inner sealing interface of the outer sleeve with the connector body when the connector assembly is connected to the case;

an outer gasket positioned to seal an outer sealing interface of the outer sleeve with the case when the connector assembly is connected to the case, and a second barrier element on an inner surface of the outer sleeve, the second barrier element to interface with the first barrier element to prevent removal of the outer sleeve from the connector body while permitting the rotation of the outer sleeve around the connector body.

2. The connector assembly of claim 1 wherein the securing region comprises two or more bayonet arms to engage corresponding grooves of the case when the connector assembly is connected with the case.

3. The connector assembly of claim 1 wherein the securing region comprises two or more grooves to engage corresponding bayonet arms of the case when the connector assembly is connected with the case.

4. The connector assembly of claim 1 wherein the first barrier element includes a ridge and the second barrier element includes a groove.

5. The connector assembly of claim 1 wherein the first barrier element includes a groove and the second barrier element includes a ridge.

6. The connector assembly of claim 1 wherein the electrical conductor includes a male pin.

7. The connector assembly of claim 1 wherein the electrical conductor includes a female socket.

8. The connector assembly of claim 1, wherein the inner gasket is configured to be compressed against the inner sealing interface of the outer sleeve surrounding a circumference of the connector body.

9. A connector assembly for providing a waterproof connection to a case and to an electronic device installed in the case, the connector assembly comprising:

a connector body including a first barrier element on an outer surface of the connector body;

an electrical transmission element attached to the connector body and electrically connected to an electrical cable, the electrical transmission element adapted to electrically engage an electrical interface of the installed electronic device through an aperture of the case to convey at least one of data and power between the installed electronic device and the electrical cable when the connector assembly is removably connected to the case; and a sleeve surrounding at least a portion of the connector body, the sleeve configured to freely rotate around the connector body to connect the connector assembly to the case at the aperture, the sleeve comprising:

a securing feature on a first end of the sleeve to removably connect the connector assembly to the case when the sleeve is rotated around the connector body, the securing feature comprising two or more bayonet arms to engage corresponding grooves of the case when the connector assembly is connected with the case;

an inner gasket positioned to seal an inner sealing surface of the sleeve with the connector body when the connector assembly is connected to the case;

an outer gasket positioned to seal an outer sealing surface of the sleeve with the case when the connector assembly is connected to the case, and a second barrier element on an inner surface of the sleeve, the second barrier element to interface with the first barrier element to prevent removal of the sleeve from the connector body while permitting the rotation of the sleeve around the connector body.

10. The connector assembly of claim 9 wherein the electrical transmission element includes a headphone plug and the connector assembly is adapted for connecting headphones to the electronic device.

11. The connector assembly of claim 9 wherein the securing feature comprises two or more grooves to engage corresponding bayonet arms of the case when the connector assembly is connected with the case.

12. The connector assembly of claim 9 wherein the securing feature comprises threads adapted to engage corresponding threads of the case when the connector assembly is connected with the case.

13. The connector assembly of claim 9 wherein the electrical cable includes audio control buttons.

14. The connector assembly of claim 9, wherein the inner gasket is configured to be compressed against the inner sealing interface of the outer sleeve surrounding a circumference of the connector body.

15. A connector for providing a water resistant connection to an encasement and to a portable electronic device installed in the encasement, the connector comprising:

a connector body;

an electrical plug attached to the connector body and electrically connectable to an electrical cable, the electrical plug to electrically engage an electrical interface of the installed portable electronic device through an opening in the encasement to convey at least one of data and power between the installed portable electronic device and the electrical cable when the connector is removably connected to the encasement;

a sleeve including a gripping region, the sleeve rotatably coupled to the connector body such that a force received at the gripping region rotates the sleeve relative to the connector body to connect the connector body to the encasement at the opening, the sleeve further comprising a first gasket positioned to seal an inner sealing surface of the sleeve with the connector body when the connector is connected to the encasement and a second gasket positioned to seal an outer sealing surface of the sleeve with the encasement when the connector is connected with the encasement, wherein the first gasket comprises an O-ring and the sleeve further comprises a gasket seat for receiving the O-ring, and a securing feature to removably secure the connector body to the encasement when the sleeve is rotated relative to the connector body, the securing feature including two or more bayonet arms to engage corresponding grooves of the case when the connector assembly is connected with the encasement.

16. The connector of claim 15 wherein the electrical plug includes a male pin.

17. The connector of claim 15 wherein the electrical plug includes a female socket.

18. The connector of claim 15 further comprising a securing feature to removably secure the connector body to the encasement when the sleeve is rotated relative to the connector body, the securing feature including threads adapted to engage corresponding threads of the encasement when the connector assembly is connected with the encasement.

19. The connector of claim 15, wherein the first gasket is configured to be compressed against the inner sealing interface of the sleeve surrounding a circumference of the connector body.

* * * * *